US008146668B2

(12) United States Patent
Bell

(10) Patent No.: US 8,146,668 B2
(45) Date of Patent: Apr. 3, 2012

(54) DOWNHOLE TUBULAR LIFTER AND METHOD OF USING THE SAME

(75) Inventor: Gavin J. Bell, Aberdeen (GB)

(73) Assignee: Halliburton Energy Services Inc., Duncan, OK (US)

( * ) Notice: Subject to any disclaimer, the term of this patent is extended or adjusted under 35 U.S.C. 154(b) by 278 days.

(21) Appl. No.: 12/480,580

(22) Filed: Jun. 8, 2009

(65) Prior Publication Data

US 2010/0307768 A1 Dec. 9, 2010

(51) Int. Cl.
*E21B 23/00* (2006.01)

(52) U.S. Cl. ..... 166/377; 166/98

(58) Field of Classification Search ..... 166/377, 166/98, 382, 393, 361; 414/187, 254, 405; 294/86.15

See application file for complete search history.

(56) References Cited

U.S. PATENT DOCUMENTS

| | | | | |
|---|---|---|---|---|
| 2,806,534 | A * | 9/1957 | Potts | 166/98 |
| 2,991,834 | A * | 7/1961 | Kennard | 166/55.7 |
| 4,044,826 | A * | 8/1977 | Crowe | 166/120 |
| 4,474,244 | A * | 10/1984 | Beynet | 166/377 |
| 4,745,969 | A | 5/1988 | Henderson | |
| 5,253,710 | A | 10/1993 | Carter et al. | |
| 6,009,941 | A | 1/2000 | Haynes | |
| 6,745,842 | B2 | 6/2004 | Hughes et al. | |
| 7,156,170 | B2 | 1/2007 | Fotland et al. | |

FOREIGN PATENT DOCUMENTS

| | | | |
|---|---|---|---|
| WO | 2004016901 | A1 | 2/2004 |
| WO | 2008118697 | A2 | 10/2008 |
| WO | 2008118697 | A3 | 10/2008 |
| WO | 2010142949 | A2 | 12/2010 |

OTHER PUBLICATIONS

Foreign communication from a foreign counterpart application—International Search Report and Written Opinion, PCT/GB2010/001127, Dec. 20, 2010.

Norse Cutting & Abandonment Marketing Brochure, Technical Description, NCA Conductor Jacking System, Document No. 2279-06, Rev. 0, 4 pages, Oct. 17, 2003, Norse Group.

Norse Cutting & Abandonment Marketing Brochure, Sectioning of Multi-String Conductors, 2 pages, 2007, www.nca-group.com.

Norse Cutting & Abandonment Marketing Brochure, Technical Description, NCA Conductor Removal System Surface Sectioning, Handling and Cleaning, Document No. 2279-04, Rev. 1, 8 pages, Jun. 16, 2005.

* cited by examiner

*Primary Examiner* — Cathleen Hutchins
(74) *Attorney, Agent, or Firm* — John W. Wustenberg; Conley Rose, P.C.

(57) ABSTRACT

A method of raising a tubular, comprising attaching a lifter to a tubular associated with a wellbore, and operating the lifter to transmit a downward force to a subterranean formation via a surface of the wellbore formed in the subterranean formation while also operating the lifter to transmit an upward force to the tubular. A lifter for lifting a tubular associated with a wellbore comprising a securing mechanism configured to restrict movement of the securing mechanism relative to an upper tubular portion, and a piston configured to be received within a lower tubular portion and configured to promote a seal between the piston and the lower tubular portion.

20 Claims, 17 Drawing Sheets

DOWNHOLE TUBULAR LIFTER AND METHOD OF USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A subterranean formation or zone may serve as a source for a natural resource such as oil, gas, or water. To produce such a natural resource from the subterranean formation, a wellbore may be drilled into the subterranean formation. Where the subterranean formation from which the natural resource is to be produced lies beneath a body of water, a tubular (e.g., a conductor) may extend from the surface or near the surface of the body of water through the body of water to a depth within the wellbore. The annular space between the tubular and the wellbore may be cemented, thereby securing the tubular to the wellbore and isolating the various production zones within the wellbore. The tubular may comprise multiple concentric strings of pipe and the annular space between the concentric pipe strings may be cemented, thus providing a conduit for the communication of fluids produced from the subterranean formation.

When a wellbore has reached the end of its useful life, becomes unproductive, is damaged, or is otherwise no longer desirable to operate, an operator may choose to abandon the wellbore. Before the wellbore may be abandoned, it must be decommissioned. Where a tubular, such as a conductor, rises through a body of water, various decommissioning regulations generally dictate that the tubular be removed from the water.

Removal of the tubular is often a difficult, time-consuming, and expensive under-taking, often due in some part to the weight of the tubular that must be removed from the water. This is particularly true in a scenario where the tubular comprises multiple concentric pipes with cement filling the space between those pipes or where the tubular extends a great depth, sometimes hundreds, thousands, or even tens of thousands of feet below the surface of the body of water. Conventionally, removal of the tubular has been accomplished via the use of cranes, hoists, and the like, often located on the platform or on other surface vessels. However, the weight of the tubular may approach or exceed the lifting/load capacity of the cranes, hoists, platform, or support vessels. Thus, conventionally, it may be necessary to cooperatively use several cranes located on multiple surface vessels or platforms to achieve the necessary lifting capacity, making removal of the tubular difficult, expensive, and time-consuming. Therefore, a need exists for improved systems and methods for decommissioning wellbores.

SUMMARY

Disclosed herein is a method of raising a tubular, comprising attaching a lifter to a tubular associated with a wellbore, and operating the lifter to transmit a downward force to a subterranean formation via a surface of the wellbore formed in the subterranean formation while also operating the lifter to transmit an upward force to the tubular.

Also disclosed herein is a lifter for lifting a tubular associated with a wellbore comprising a securing mechanism configured to restrict movement of the securing mechanism relative to an upper tubular portion, and a piston configured to be received within a lower tubular portion and configured to promote a seal between the piston and the lower tubular portion.

In an embodiment, a method of raising a portion of a tubular disposed within a wellbore penetrating a formation as disclosed herein comprises dividing the tubular at depth, thereby resulting in an upper tubular portion and a lower tubular portion. In this embodiment, the method further comprises positioning within the tubular an apparatus configured to exert a substantially upward force against the upper tubular portion and to exert a substantially downward force against the lower tubular portion, transferring a substantially upward force against the upper tubular portion, and transferring a substantially downward force to the formation via a surface of the wellbore.

In an embodiment, a method of decommissioning a wellbore penetrating a formation as disclosed herein comprises plugging a tubular at a depth with a plug and dividing the tubular at a depth above the depth at which the tubular was plugged, thereby resulting in an upper tubular portion and a lower tubular portion, the plug being disposed within the lower tubular portion. In this embodiment, the method further comprises positioning at least a portion of a lifting apparatus within the tubular, securing a portion of the lifting apparatus to the upper tubular portion, providing a seal between the lifting apparatus and the lower tubular portion, the seal slidably fitted against the inner surface of the lower tubular portion, and pumping a fluid into a void or chamber from below the seal and above the plug.

In an embodiment, the method may further comprise severing the upper-most segment of the upper tubular portion from the upper tubular portion, and removing the severed upper-most segment of the upper tubular portion.

In an embodiment, plug may be a cement plug.

In an embodiment, the tubular may comprise two or more concentric cylindrical members. In such an embodiment, the method may further comprise securing an outermost cylindrical member to at least one cylindrical member disposed within the outermost cylindrical member, such that the outermost cylinder will not move with respect to the at least one cylindrical member disposed there within.

In an embodiment, a method of decommissioning a wellbore penetrating a formation as disclosed herein comprises plugging a tubular at a depth with a plug and dividing the tubular at a depth above the depth at which the tubular was plugged, thereby resulting in an upper tubular portion and a lower tubular portion, the plug being disposed within the lower tubular portion. In an embodiment, the method further comprises positioning at least a portion of a lifting apparatus within the tubular, securing a portion of the lifting apparatus to the upper tubular portion, and pressurizing an internal chamber of the lifting apparatus and thereby causing the lifting apparatus to be extended.

In an embodiment, a method of decommissioning a wellbore penetrating a formation as disclosed herein comprises plugging a tubular at a depth with a plug, dividing the tubular at a depth above the depth at which the tubular was plugged, thereby resulting in an upper tubular portion and a lower tubular portion, the plug being disposed within the lower tubular portion, positioning at least a portion of a lifting apparatus within the tubular, securing a first component of the lifting apparatus to the upper tubular portion, and causing a second component of the lifting apparatus to rotate with respect to the first component of the lifting apparatus such that the lifting apparatus is extended.

In an embodiment, a system for decommissioning a wellbore as disclosed herein comprises an apparatus comprising a first portion configured to be secured to an upper portion of a tubular and a second portion configured to transmit a substantially downward force, wherein the force is transferred to the formation via a surface of the wellbore.

In an embodiment, a system for decommissioning a wellbore comprises a tubular severed at a point below the surface of the formation, thereby resulting in an upper tubular portion and a lower tubular portion, and a plug set within the tubular at a point below the point at which the tubular is severed. In an embodiment, the system further comprises an apparatus anchored to the upper tubular portion comprising a means of anchoring the apparatus to the upper tubular portion and a piston slidably fitted against the inner surface of the lower tubular portion, thereby creating a substantially fluid-tight void between the piston and the plug and a fluid pumped into the substantially fluid-tight void between the plug and the piston such that an upward force is exerted against the upper portion of the tubular via the anchoring means and a downward force is exerted against the plug. In an embodiment, the system further comprises a fluid pumped into the void between the plug and the piston such that an upward force is exerted against the upper tubular portion and a downward force is exerted against the plug.

In an embodiment, a system for decommissioning a wellbore comprises a tubular severed at a point below the surface of the formation, thereby resulting in an upper tubular portion and a lower tubular portion, and a plug set within the tubular at a point below the point at which the tubular is severed. In an embodiment, the system further comprises an apparatus anchored to the upper tubular portion, the apparatus comprising a piston slidably inserted within a cylinder, one end of the cylinder being capped, a mandrel coupled to the piston and extending from the uncapped end of the cylinder, and a substantially fluid-tight chamber within the cylinder between the piston and the capped end of the cylinder. In an embodiment, the system further comprises a fluid pumped into the chamber between the capped end of the cylinder and the piston such that an upward force is exerted against the upper tubular portion and a downward force is exerted against the plug.

In an additional embodiment, a system for decommissioning a wellbore comprises a tubular severed at a point below the surface of the formation, thereby resulting in an upper tubular portion and a lower tubular portion, and a plug set within the tubular at a point below the point at which the tubular is severed. In an embodiment, the system further comprises an apparatus anchored to the upper tubular portion comprising an internally-threaded housing comprising means of anchoring the housing to the upper tubular portion, an externally-threaded mandrel extending through the housing; and a rotational force applied such that the housing rotates with respect to the mandrel such that an upward force is exerted against the upper portion of the tubular via the anchoring means and a downward force is exerted against the plug. In an embodiment, the system further comprises a fluid pumped to the apparatus, thereby causing a rotational force to be applied to the housing with respect to the mandrel.

DETAILED DESCRIPTION

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation or the surface of a body of water; likewise, use of the terms "down," "lower," "downward," "downhole," or other like terms shall be construed as generally toward the bottom, deeper end of the well, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Figure 1A:
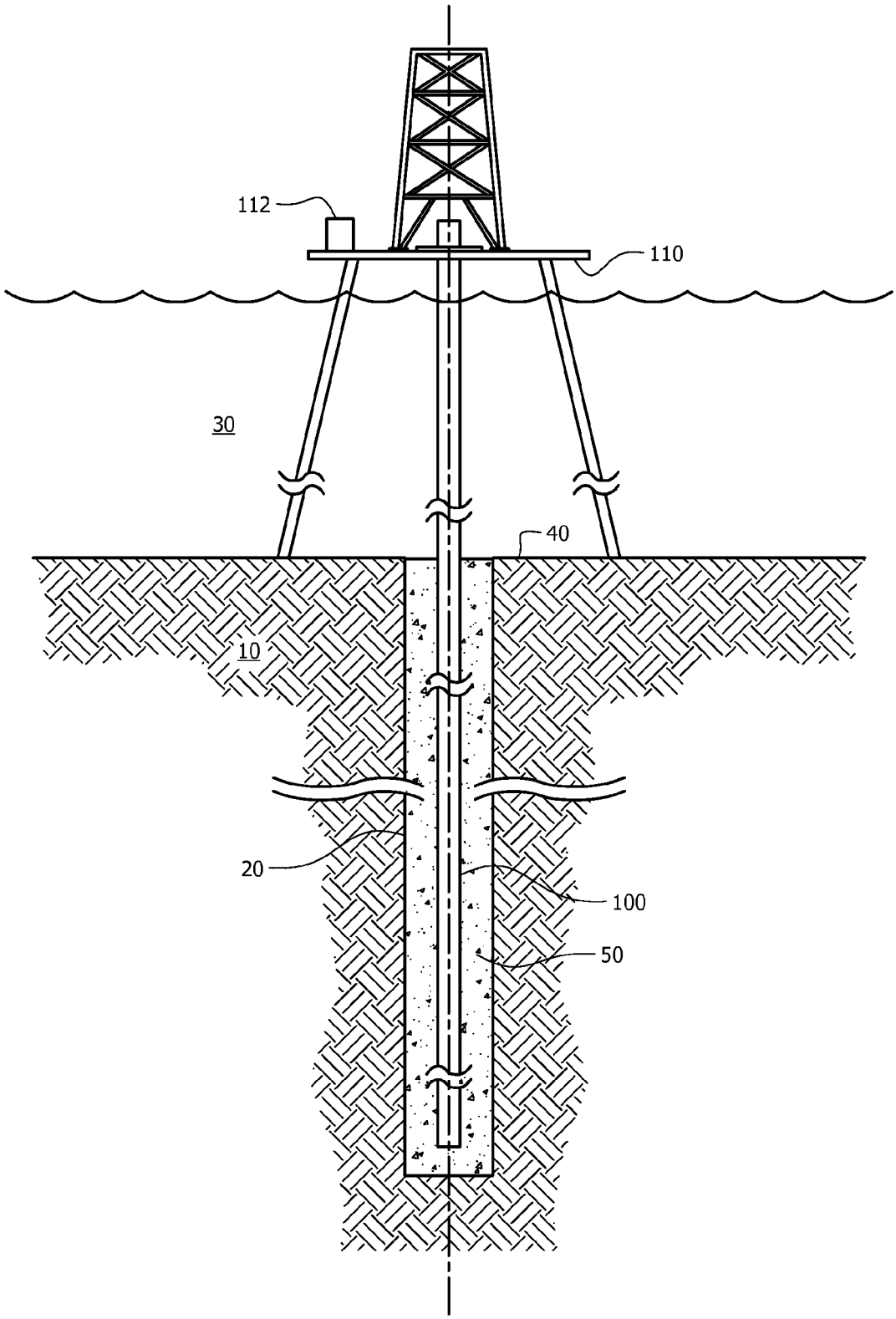
FIG. 1A is an illustration of the operating environment of the invention depicting an offshore platform with a tubular descending therefrom into a wellbore that penetrates a subterranean formation.

Referring to FIG. 1A, an operating environment for performing a method of decommissioning a wellbore that penetrates a subterranean formation is shown. While the discussion herein refers to a subterranean formation beneath a body of water, it will be appreciated that one or more of the following embodiments may be employed in an alternative operating environment where a subterranean formation is other than beneath a body of water. FIG. 1A illustrates a tubular 100 extending from a platform 110, through a body of water 30, and extending into a wellbore 20 that penetrates a subterranean formation 10.

The wellbore 20 may be formed by drilling into the subterranean formation 10 using any suitable drilling technique. In FIG. 1A, the wellbore 20 extends substantially vertically beneath the body of water 30 over a vertical wellbore portion. However, in alternative embodiments, a wellbore may deviate at any angle from the earth's surface over a deviated, curved, and/or horizontal wellbore portion. A tubular 100 extends substantially vertically through the body of water 30 from within the wellbore 20. In alternative embodiments, a tubular may extend in any other direction, at any angle from the surface of the body of water, and to any depth within the body of water. In FIG. 1A, the tubular 100 extends beyond the surface 40 (e.g., ocean floor or mudline) where the tubular 100 is received through a platform 110 (e.g., a drilling and/or production vessel or platform). As shown in FIG. 1A, the tubular 100 extends above the platform 110 where the tubular is connected to other wellbore servicing equipment. In alternative embodiments, the tubular may be coupled to a related support vessel. In further alternative embodiments, the tubular may extend toward the surface of the body of water but not extend out of the body of water. In various embodiments, a tubular may comprise one or more wellheads, one or more risers, one or more pipelines, and/or various combinations thereof.

Figure 1B:
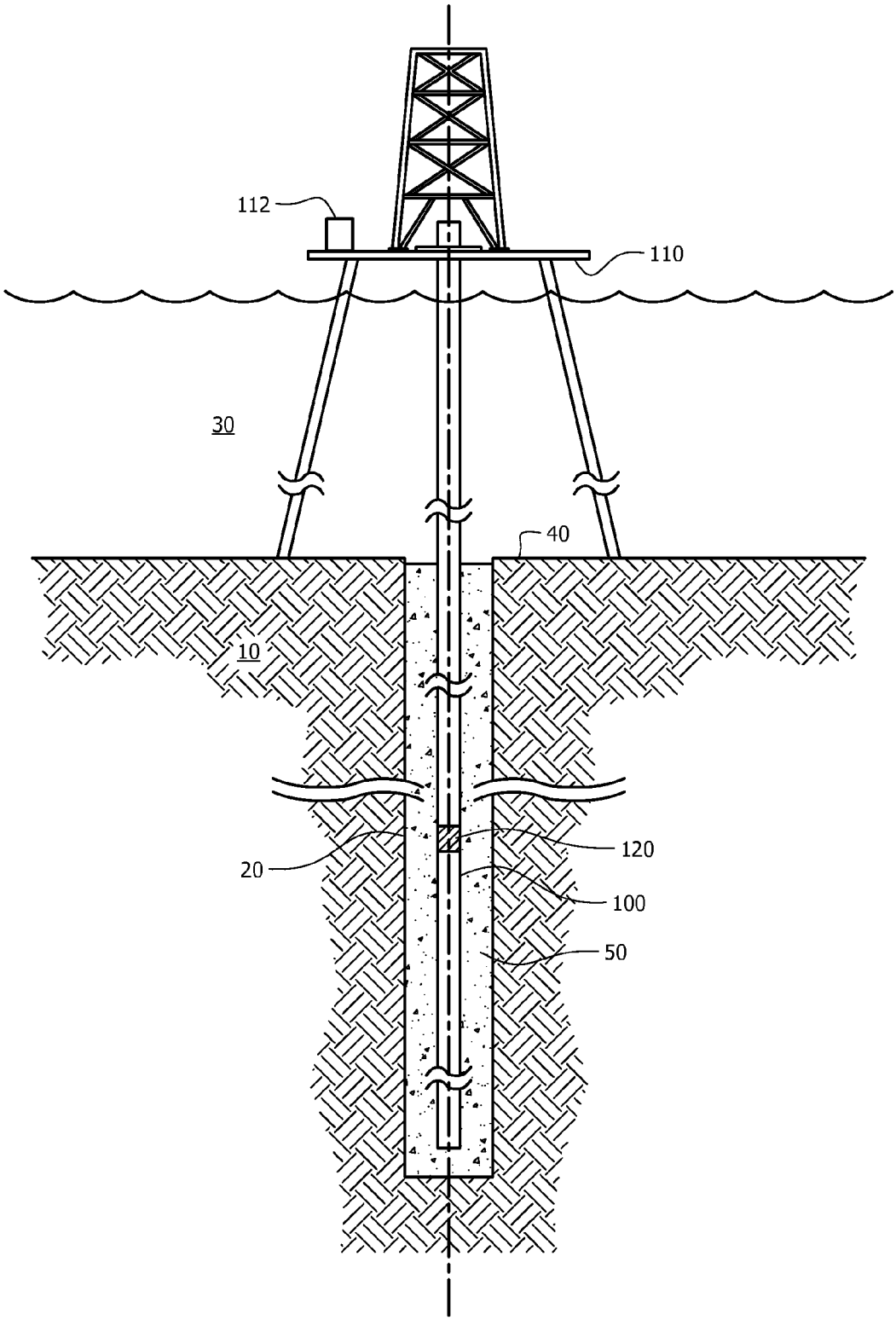
FIG. 1B is an illustration of the operating environment, wherein a base has been provided within the tubular at a depth below the mud-line.
Figure 1C:
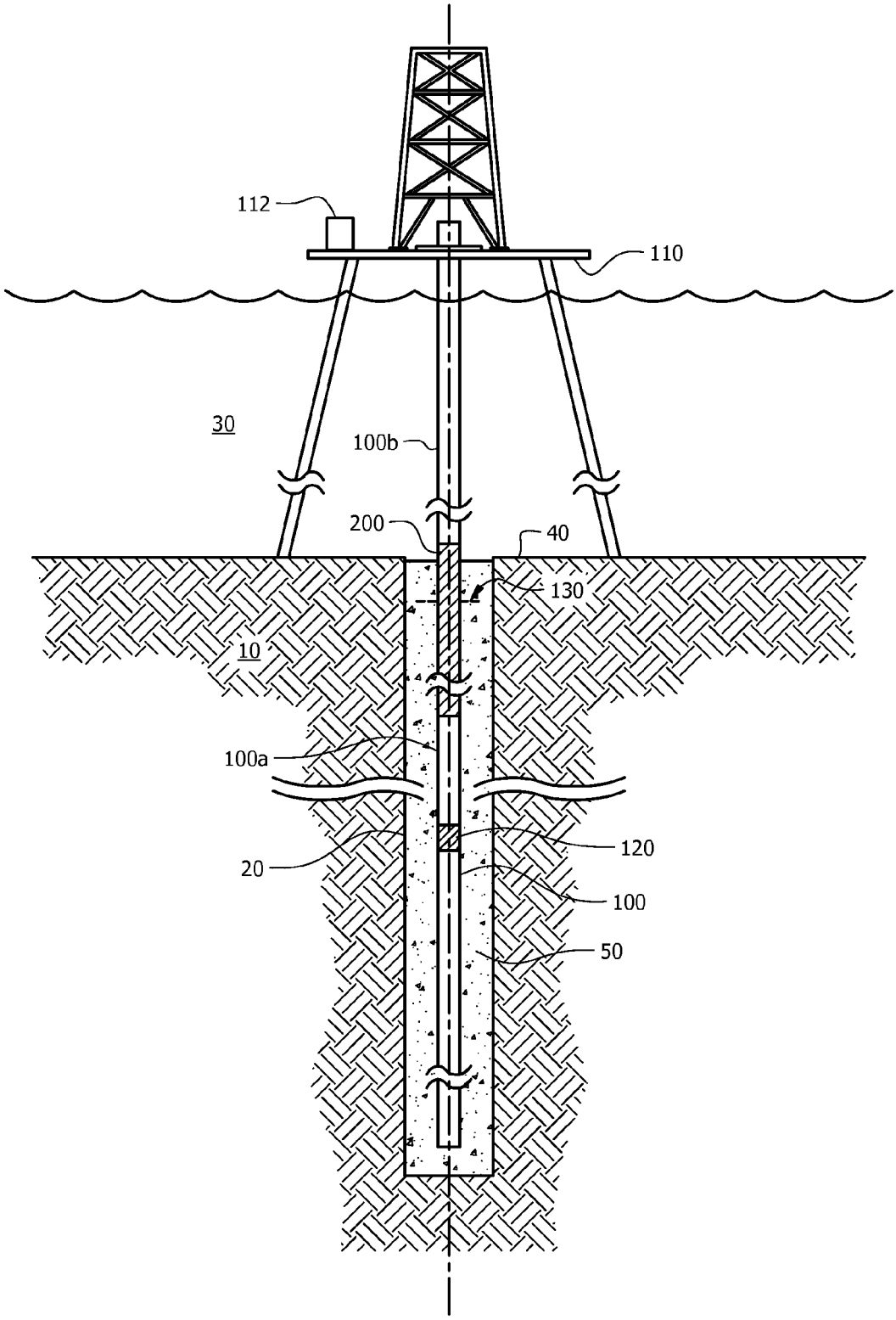
FIG. 1C is an illustration of the operating environment, wherein the tubular has been severed and a lifter has been provided within the tubular.

In this embodiment, at least a portion of the tubular 100 secured within the wellbore 20 through the use of cement 50 disposed within a generally annular space between the exterior of the tubular 100 and the surfaces of the wellbore 20. It will further be appreciated that other embodiments of this disclosure may incorporate similar use and/or placement of cement 50 to secure portions of tubulars 100 within wellbores 20. While cement 50 is shown in FIGS. 1A-1C as being disposed substantially along the entire length of the wellbore 20, in alternative embodiments, cement 50 may be disposed between the tubular 100 and the wellbore 20 only partially along the length of the wellbore 20, as discontinuous sections along the length of the wellbore 20, or in any other suitable manner. The tubular 100 may comprise other components as described in greater detail herein.

In some embodiments, the systems, methods and apparatuses disclosed herein may be employed for the purpose of lifting a tubular, such as tubular 100, or a portion thereof. More specifically, the systems, methods, and apparatuses disclosed herein may be employed to practice a decommissioning process that requires lifting a tubular that extends into a wellbore such as wellbore 20. In other embodiments, the systems, methods, and apparatuses disclosed herein may be employed to remove a portion of a tubular, such as tubular 100, from within a subterranean formation and/or from within a body of water such as the body of water 30.

Referring generally to FIGS. 1B-1F, successive stages of a method of decommissioning a wellbore 20 are shown. The method generally comprises providing a base which will transfer the weight of the tubular 100 to the subterranean formation 10, severing the tubular 100, inserting a lifter 200 or a portion thereof within the tubular 100, and operating the lifter 200 to lift a severed portion of the tubular 100, wherein during such lifting, a substantially downward force is transferred to the formation 10 via at least one surface of the wellbore 20.

In alternative embodiments, a method may further comprise additionally severing an uppermost segment of the severed tubular, re-routing connections associated with that uppermost segment of the tubular to the lifter, removing the uppermost segment of the tubular, and securing multiple concentric tubular members relative to each other so that movement of one of the multiple concentric tubular members results in substantially similar movement of the other secured tubular members.

Referring now to FIG. 1B, the method of decommissioning the wellbore 20 is shown as comprising providing a base 120 within the tubular 100. In this embodiment, the base 120 comprises a structure capable of opposing a substantially downward force applied against the base 120 from within the tubular 100. Such downward force is transferred, directly and/or indirectly, to the formation 10. In an embodiment, base 120 comprises a cement plug. It will be appreciated that some wellbore decommissioning standards require installation of one or more cement plugs and that base 120 may be configured to satisfy such standards.

In alternative embodiments, a base may comprise a structure designed to selectively mechanically engage the walls of a tubular, thereby selectively providing a force transfer path between the base and the tubular. Alternatively, a base may comprise a structure configured to selectively engage one or more surfaces of a wellbore (e.g., the side-walls or bottom) and thereby selectively providing a force transfer path between the base and the wellbore.

In the embodiment of FIG. 1B, the base 120 is provided within the tubular 100 below a part of the tubular 100 that is to be lifted and removed. In this embodiment, the base 120 is provided at a depth below the surface 40. In an alternative embodiment, a base may be provided within a tubular such as tubular 100 at a depth/height substantially adjacent to surface 40 or at a depth/height above surface 40.

Referring now to FIG. 1C, the tubular 100 is shown as having been severed, thereby resulting in a lower tubular portion 100*a* and an upper tubular portion 100*b*. As shown by cut-line 130, the tubular 100 is severed at depth upward or uphole from the base 120. In the embodiment of FIG. 1C, the cut-line 130 is below the surface 40. In alternative embodiments, the tubular may be severed at a depth/height substantially adjacent to surface 40 or at a depth/height above surface 40.

Severing the tubular 100 comprises employing any suitable device, system, and/or method of dividing the tubular 100 thereby resulting in two portions thereof. As will be recognized by one of skill in the art with the aid of this disclosure, severing the tubular 100 may be accomplished in a variety of ways using a variety of tools and machinery. In an embodiment, severing the tubular 100 may comprise cutting the tubular using a suitable apparatus (e.g., a cutting torch, a plasma torch, a water jet, a cavitation jet, and the like that is configured for use within a downhole portion of a tubular). In an embodiment, the tubular is cut with a radial explosive cutter (e.g., a casing cutter having a 360° assembly of shaped charges) that is lowered inside the tubular on a workstring (e.g., coiled tubing or wireline). In alternative embodiments, the tubular may be cut with a suitable mechanical cutting device. Nonlimiting examples of a suitable such mechanical cutting device include a rotating mechanical cutter, an oscillating blade saw or a band saw. In still other alternative embodiments, where a tubular comprises multiple segments joined together (as by a joining collar or threaded joint), severing the tubular may comprise unthreading the joint or disconnecting the joining collar. Further, severing the tubular may comprise separating, segmenting, or otherwise breaking up a portion of cement 50.

In some embodiments, a lifter, which will be discussed in greater detail below, may be employed to apply an upward force to the upper tubular section while the cutting tool or device is operated. As will be appreciated by those of ordinary skill in the art, such operation of a lifter prevents the weight of the upper section from closing a gap and trapping the cutting device (e.g. a mechanical cutting device such as a band saw). Conventionally, the conductor tubular was pulled upward by tension applied from a barge-mounted jacking device or a platform-mounted crane prior to severing the tubular. Accordingly, in some embodiments, such conventional means of providing upward force may be used to supplement the upward force provided by the lifter during the severing of the tubular. In an embodiment, the cutting tool or device may be incorporated with or coupled, connected, or otherwise operably joined to such a lifter, which will be discussed in greater detail below.

In the embodiment of FIG. 1C, a lifter 200 (which will be discussed in greater detail below) or a portion thereof, is inserted within the tubular 100. In this embodiment, the lifter 200 is inserted within the tubular 100 and lowered to a depth in the wellbore uphole from the base 120. In this embodiment, there is a distance between the bottom end of the lifter 200 and the top end of the base 120 (e.g., a space may be present between the bottom of the lifter 200 and the base 120). In alternative embodiments, a lifter may rest directly on a base. In this embodiment, at least some part or component of the lifter 200 is positioned uphole from the cut-line 130 and at least some part or component of the lifter 200 is positioned downhole from the cut-line 130 (e.g., the lifter 200 straddles the cut-line 130).

As described in greater detail below, the lifter 200 comprises a securing mechanism. The securing mechanism may be actuated, as will be discussed in greater detail, to engage the upper tubular portion 100*b*, thereby restricting the movement of at least a portion of the lifter 200 with respect to at least a portion of the upper tubular portion 100*b*.

The lifter 200 is further configured to generate and/or transfer a substantially upward force to the upper tubular portion 100*b* while also being configured to transfer a substantially downward force to the formation 10. In some embodiments, the substantially downward force may be transferred from within the tubular 100 to the formation 10 through the base 120 and/or through the lower tubular portion 100*a*.

Figure 1D:
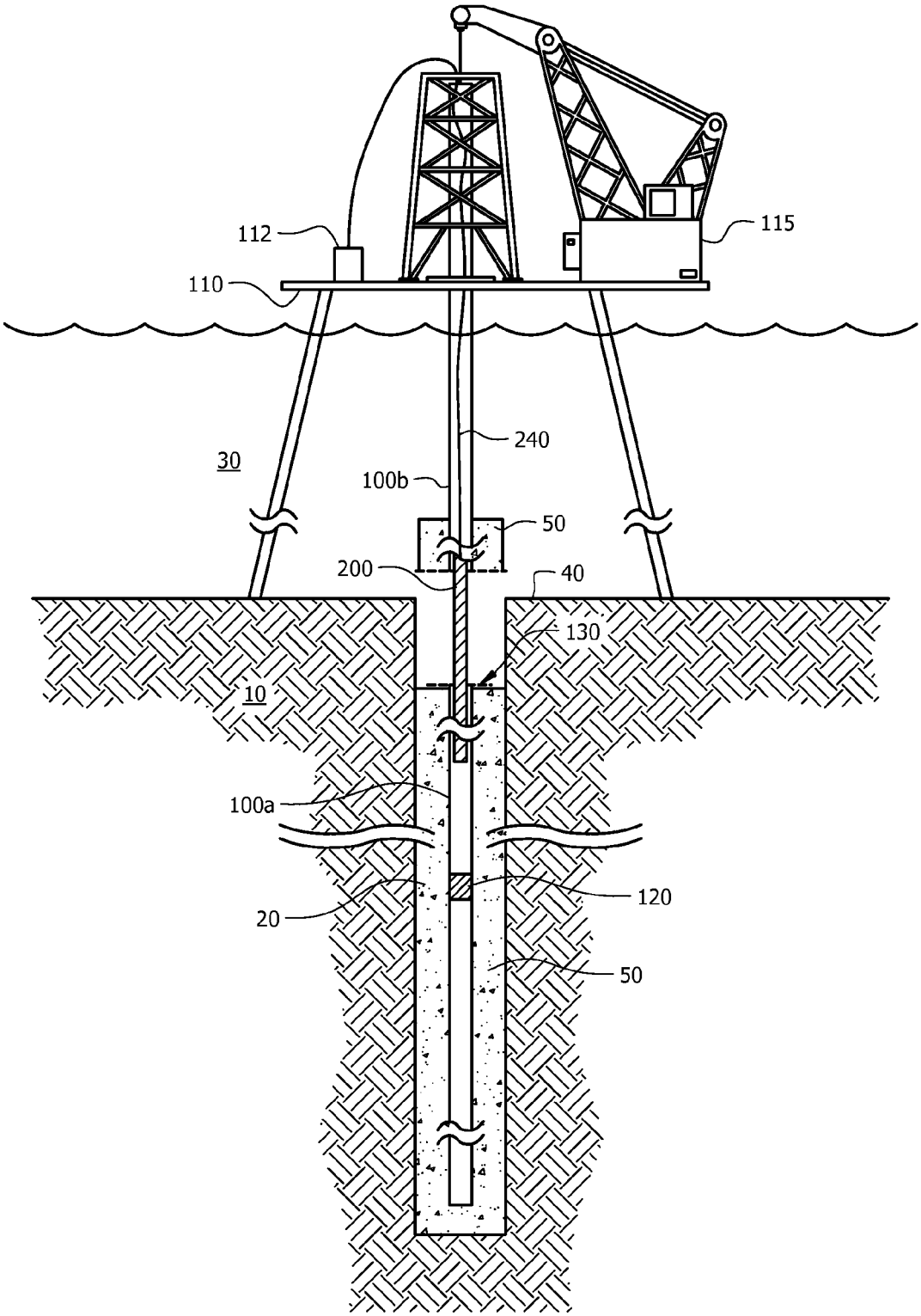
FIG. 1D is an illustration of the operating environment, wherein an upper tubular portion is being raised via the operation of the lifter.
Figure 1E:
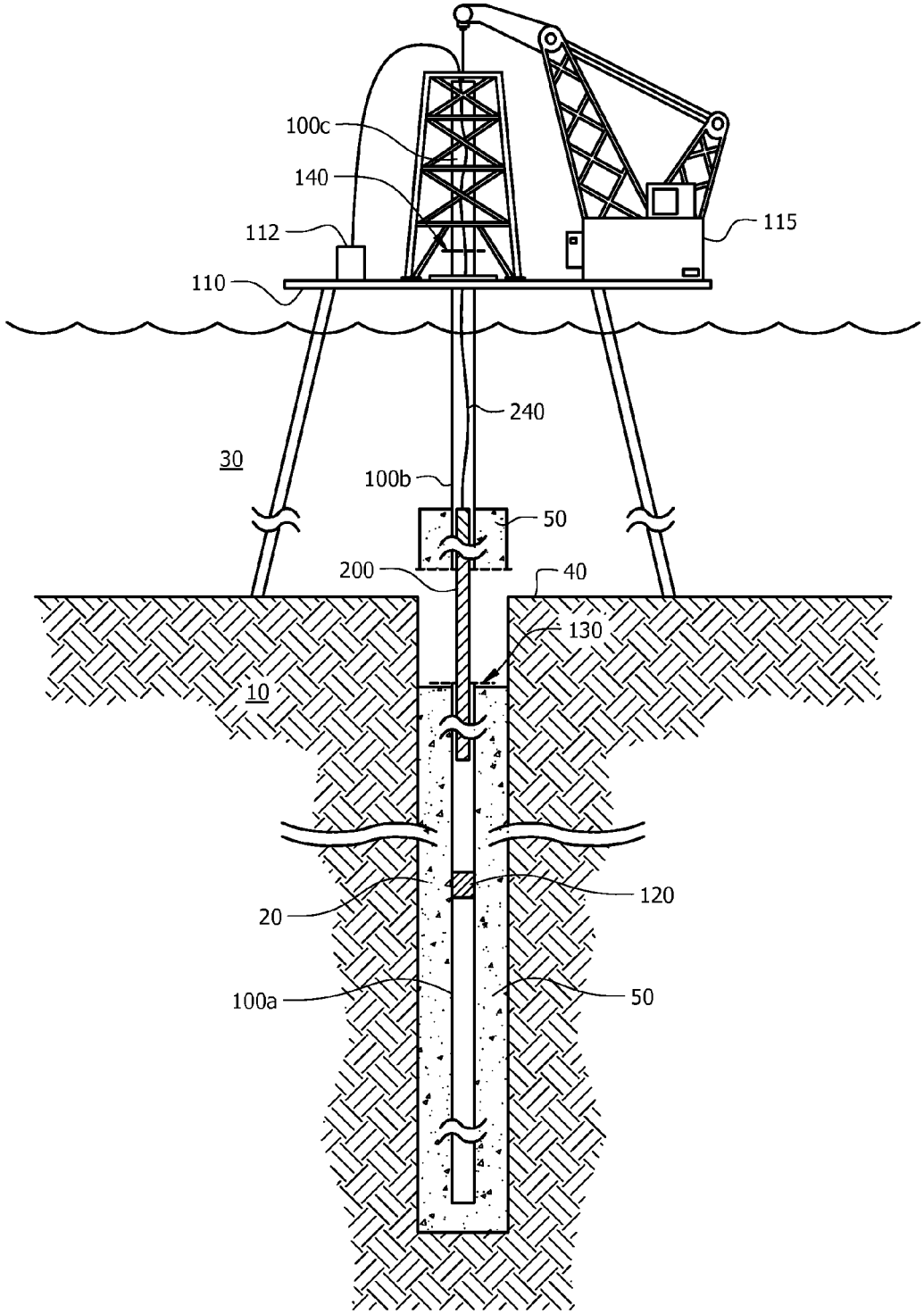
FIG. 1E is an illustration of the operating environment, wherein an uppermost segment of the tubular has been severed.
Figure 1F:
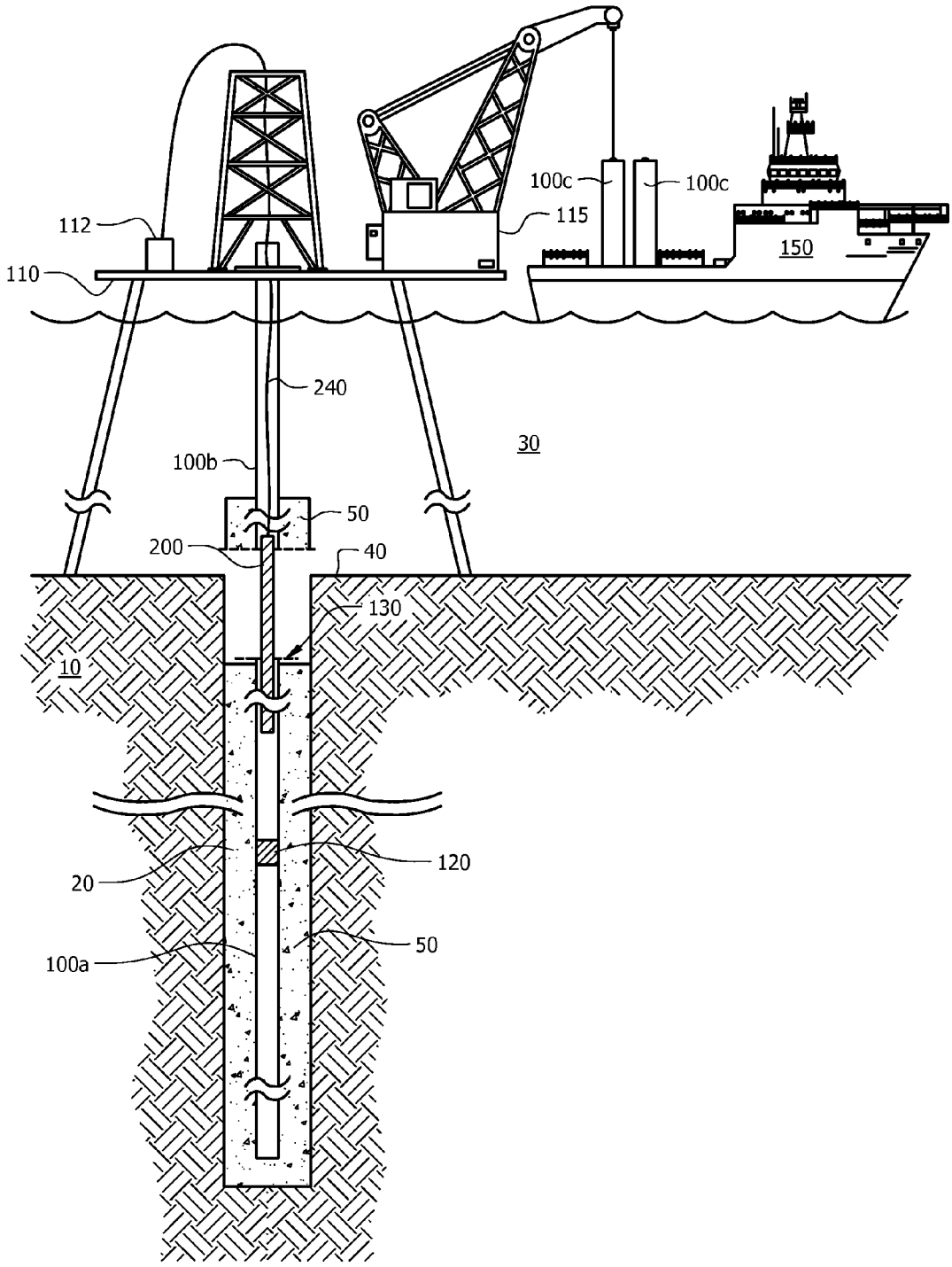
FIG. 1F is an illustration of the operating environment, wherein the uppermost segment of the tubular has been removed to a nearby support vessel.

In the embodiment of FIG. 1D, operation of the lifter 200 causes the upper tubular portion 100*b* to be elevated. In other words, the upper tubular portion 100*b* is moved upward via the operation of the lifter 200 while the lower tubular portion 100*a* remains substantially unmoved. In this embodiment and in some others, cement 50 adheres to the upper tubular portion 100*b* as the upper tubular portion 100*b* is moved upward. However, it will be appreciated that in other alternative embodiments, a tubular may be driven into a seabed and not cemented, the result of which being that no cement would adhere to the upper tubular portion 100*b* as shown in FIGS. 1D-1F and others.

In this embodiment, the upper tubular portion 100*b* may be raised to extend through and above a deck of the platform 110 by a selected distance. In this embodiment, when the uppermost end of the upper tubular portion 100*b* has reached a selected height above the deck of the platform 110, the operation of the lifter 200 is ceased and the upper tubular portion 100*b* remains with the uppermost end of the upper tubular portion 100*b* above the deck. As described in greater detail below, the lifter 200 comprises an anti-slip mechanism to selectively limit the upper tubular portion 100*b* from moving downward relative to the lifter 200 and/or to prevent the lifter 200 from moving downward relative to lower tubular portion 100*a*.

In the embodiment of FIG. 1D, the substantially downward force generated and/or transferred by the tubular lifter 200 is transferred from the tubular lifter 200 to the lower tubular portion 100*a*, from the lower tubular portion 100*a* to the base 120, and from the base 120 to the subterranean formation 10 via at least one surface of the wellbore 20. In alternative embodiments, the substantially downward force may be transferred via a base such as base 120, alternatively, via a lower tubular portion such as lower tubular portion 100*a*, alternatively, via a surface of a wellbore, alternatively, via combinations thereof. It will be appreciated that in embodiments where cement 50 is disposed between one or more elements capable of transferring and/or receiving the substantially downward force, the substantially downward force may similarly be transferred through and/or received by the cement 50. For example, in this embodiment, the substantially downward force may be transferred from the lower tubular portion 100*a* to the cement 50 and from the cement 50 to a surface of the wellbore 20. Not seeking to be bound by any particular theory of operation, by transferring the substantially downward force generated and/or transferred by lifter 200 to a subterranean formation in the manner described above, difficulties associated with conventional means of hoisting a tubular portion are lessened or alleviated. More specifically, because at least a portion of the substantially downward force is transferred to the subterranean formation without including a hoist, crane, platform, surface vessel, or any other surface equipment in the transfer path of the force, the force load limitation of such equipment is no longer a primary limiting factor in lifting capability when performing the above-described method.

Nonetheless, in this embodiment, a crane or hoist 115 located on the platform 110, or in alternative embodiments located on a support vessel, is employed in conjunction with the operation of the lifter 200. The upper tubular portion 100*b* is therefore lifted by lifter 200 and simultaneously lifted by the hoist 115. Accordingly, the lifting forces generated by the lifter 200 and the hoist 115 are combined to lift the upper tubular portion 100*b*.

The lifter 200 generally comprises a securing mechanism configured to secure the lifter 200 or a portion thereof to the tubular 100 thereby allowing the lifter 200 to elevate the upper tubular portion 100*b* by imparting a substantially-downward force to the subterranean formation 10 via at least one surface of a wellbore and a substantially upward force to the upper tubular portion 100*b*. In embodiments, the securing mechanism is operably coupled so that the substantially upward force imparted by the lifter is transferred to the upper tubular portion 100*b* via the securing mechanism.

Figure 2A:
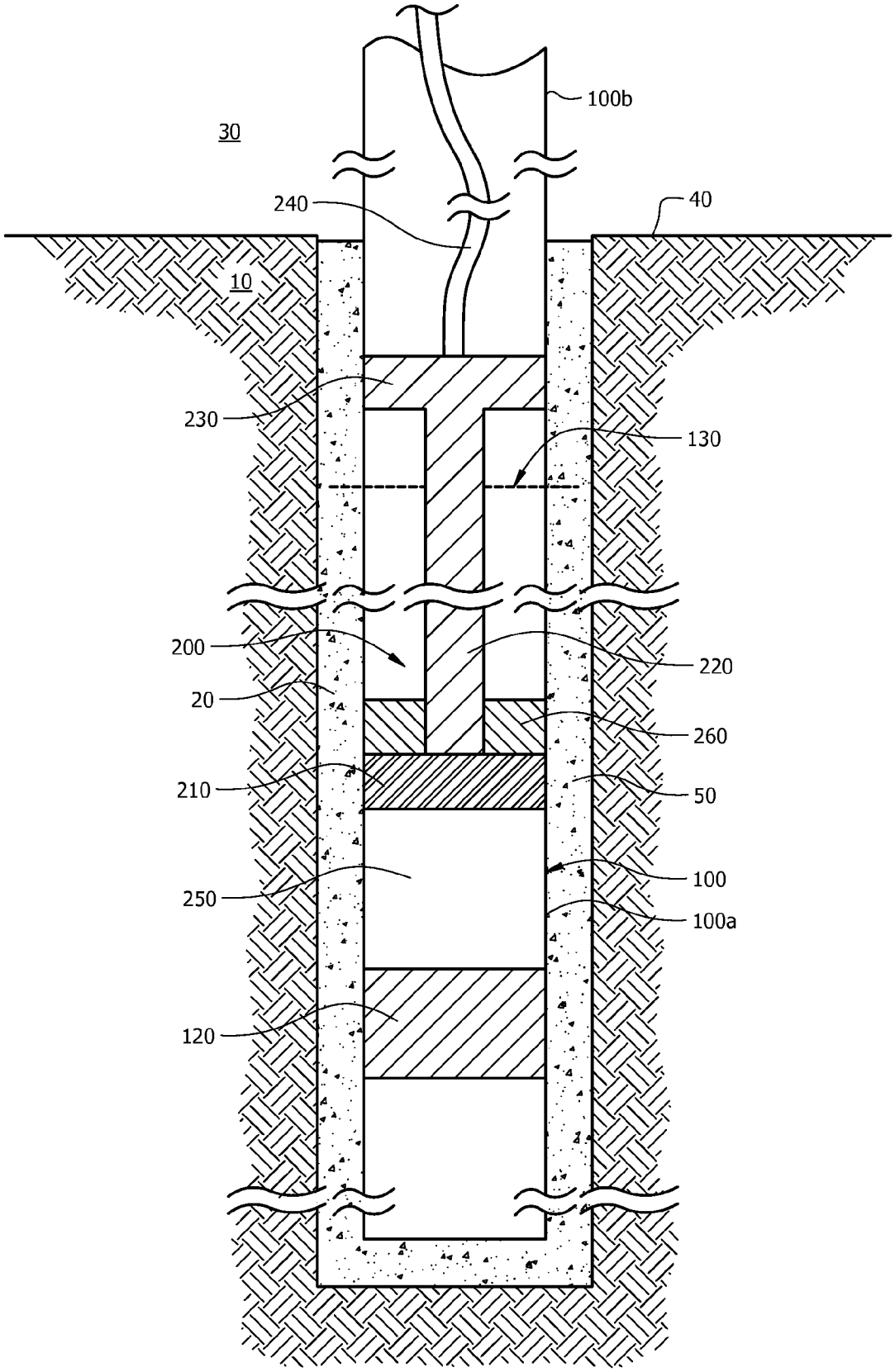
FIG. 2A is a partial cutaway view showing an embodiment of a lifter inserted within the tubular and before lifting the tubular.
Figure 2B:
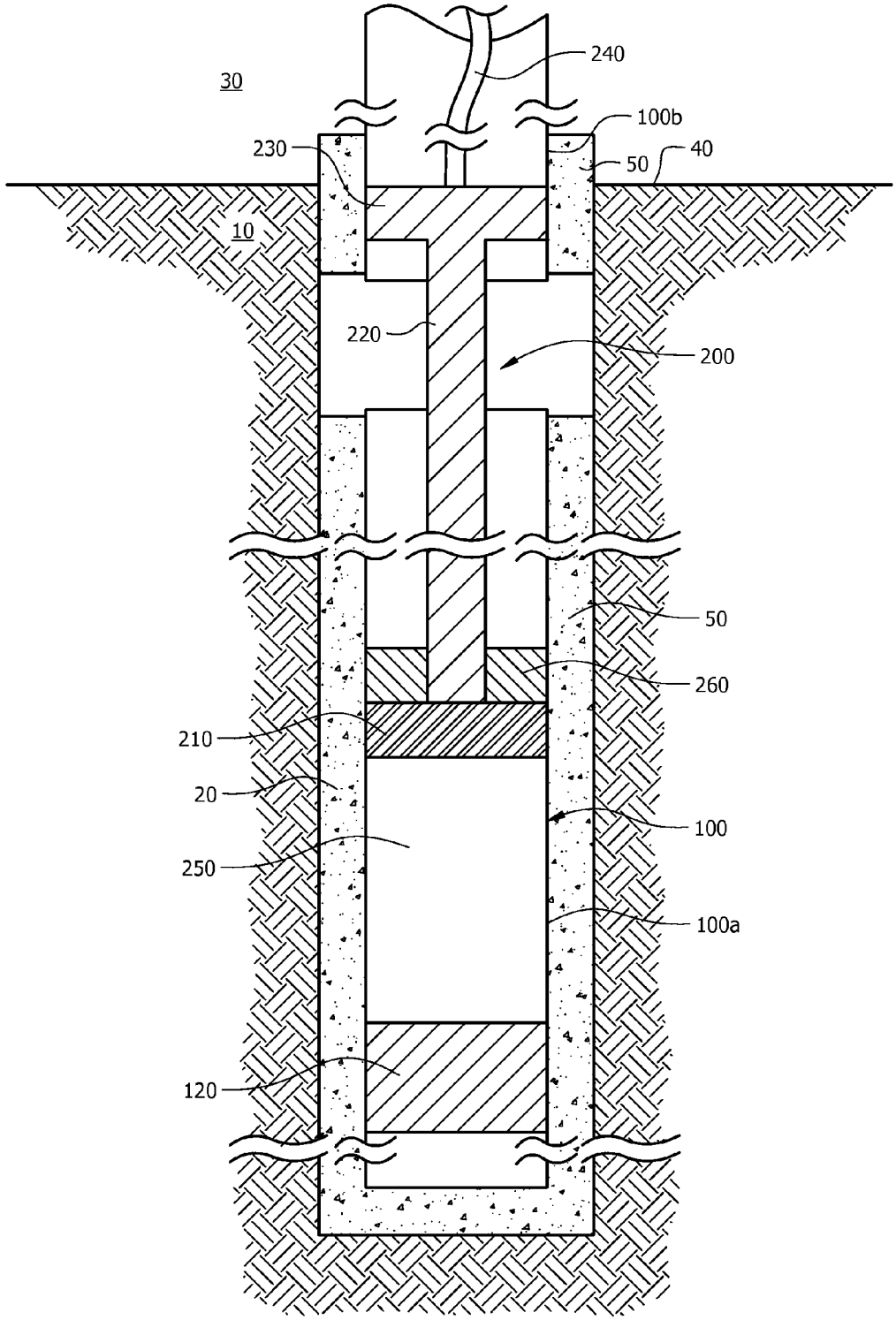
FIG. 2B is a partial cutaway view showing the lifter of FIG. 2A inserted within the tubular and after at least partially lifting the tubular.

Referring generally to FIGS. 2A and 2B, the securing mechanism 230 of the lifter 200 comprises one or more mechanisms configured for securing at least a portion of the lifter 200 to the upper tubular portion 100*b*. Not seeking to be bound by any particular theory, the securing mechanism 230 transfers a substantially upward force from the lifter 200 to the upper tubular portion 100*b*. Conversely, the weight of the upper tubular portion 100*b* causes a substantially downward force to be transferred to the lifter 200 via the securing mechanism 230.

The securing mechanism 230 is configured to selectively limit movement of at least a portion of the lifter 200 in at least one direction with respect to the upper tubular portion 100*b*. For example, the securing mechanism 230 operates to selectively limit movement of the upper tubular portion 100*b* in a generally downward direction relative to the securing mechanism 230. For example, with the securing mechanism 230 secured to or otherwise engaging the upper tubular portion 100*b*, the securing mechanism will hold the weight (i.e., the load) of the upper tubular portion 100*b*. In another embodiment, the securing mechanism 230 may be configured to take successive "bites." In such an embodiment, the securing mechanism 230 may engage the upper tubular portion 100*b*, then move down relative to the upper tubular portion 100*b*, then reengage the upper tubular portion 230. As such, the securing mechanism 230 would "grip" the upper tubular portion 100*b* in one direction only. Such directional gripping may occur when lifting the upper tubular portion 100*b* and/or when the weight of the upper tubular portion 100*b* is otherwise supported (e.g., held by a crane or hoist or the platform 110) so that the securing mechanism 230 might be moved down through the upper tubular portion 100*b* to and reset for a subsequent lifting action. In alternative embodiments, a securing mechanism may be configured to selectively limit movement of at least a portion of a lifter in at least one direction with respect to a lower tubular portion. For example, such a securing mechanism may operate to selectively limit such a lifter from moving in a generally downward direction relative to such a lower tubular portion.

Referring to FIG. 2A, the securing mechanism 230 comprises an assemblage configured to engage an interior wall of the upper tubular portion 100*b*, thereby selectively limiting movement of the upper tubular portion 100*b* with respect to the securing mechanism 230. In an embodiment, the securing mechanism 230 comprises one or more sharp, hard protrusions which, when actuated as described below, extend radially outward from the securing mechanism 230 and cut or dig into the inner wall of the upper tubular portion 100*b*. As will be appreciated by those of skill in the art and with the aid of this disclosure, the radially-extending protrusions are beveled or angled so that the radially-extending protrusions slide when moving in one direction (e.g., downhole) with respect to an adjacent inner wall of the upper tubular portion 100*b* and cut or dig into the surface the adjacent inner wall of the upper tubular portion 100*b* when moving in another direction (e.g., uphole). In alternative embodiments, a securing mechanism may comprise dogs, keys, catches, teeth, interference/friction connections, swellable or inflatable connections, the like or combinations thereof to similarly achieve a rigid, non-slip connection and/or a directional slip-type connection between a securing mechanism and an upper tubular portion.

In an embodiment, the securing mechanism 230 may be selectively actuated to cause the securing mechanism 230 to engage or disengage the interior surface of the upper tubular portion 100*b*, for example as described above. For example, the securing mechanism 230 may be hydraulically actuated. In alternative embodiments, a securing mechanism may be actuated in any other suitable manner including, but not limited to, electrically actuated, mechanically actuated, hydraulically actuated, or combinations thereof. In additional alternative embodiments, a securing mechanism may be configured to engage an interior surface of a tubular automatically and/or without being triggered by an operator. In still other alternative embodiments, a securing mechanism may be configured to engage and/or disengage an interior surface of a tubular upon the application of force in a selected direction.

In embodiments, the lifter comprises one or more mechanisms configured to impart a substantially downward force to the formation from a position within the tubular while applying a substantially upward force to an upper tubular portion.

Still referring to FIGS. 2A and 2B, the lifter 200 comprises a piston 210 slidably received in a substantially fluid-tight manner within an interior bore of the lower tubular portion 100*a*, thereby forming a chamber 250 between the piston 210 and the base 120. The piston 210 comprises at least one seal configured to lessen the escape of a fluid from the chamber 250. More specifically, the seal lessens the amount of fluid which is able to move from one side (e.g., downhole side) of the piston 210 to the other side (e.g., uphole side) of the piston 210 via the space between the piston 210 and the inner wall of the lower tubular portion 100*a*. In alternative embodiments, a piston may comprise one or more seals, O-rings, piston rings, or combinations thereof configured to similarly seal the uphole side of the piston from the downhole side of the piston.

As illustrated by FIGS. 2A and 2B, pumping a fluid into the chamber 250 causes the distance between the base 120 and the piston 210 to increase. FIG. 2A shows the lifter 200 as configured with a first fluid volume present in the chamber 250 while FIG. 2B shows the lifter 200 as positioned with a second fluid volume present in the chamber 250 where the second fluid volume is greater than the first fluid volume. In other words, as fluid is pumped in the chamber 250, the pressure within the chamber 250 increases, thereby resulting in the application of a substantially upward force against the piston 210 and a substantially downward force against the base 120. As fluid continues to be pumped into the chamber 250, the substantially upward force applied to the piston 210 forces the piston 210 upward. In the embodiment of FIGS. 2A and 2B, the base 120 engages the lower tubular portion 100*a*. As such, the substantially downward force is transferred to the base 120, from the base 120 to the lower tubular portion 100*a*, and from the lower tubular portion 100*a* to the subterranean formation 10 via at least one surface of the wellbore 20 (e.g., the lower tubular portion 100*a* cemented in place against the formation 10).

In the embodiment of FIGS. 2A and 2B, the fluid pumped into the chamber 250 comprises a non-toxic and environmentally-friendly fluid. In this embodiment, the fluid comprises sea-water. In alternative embodiments, the fluid may comprise a viscosity at least as great as that of water. In alternative embodiments, the fluid may comprise a water-based or a sea-water-based fluid. In additional alternative embodiments, the fluid may comprise one or more additives. Such additives may be included for the purpose of modifying the characteristics of the fluid (e.g., rheology, viscosity, density, and the like). In a specific alternative embodiment, the fluid is water-based or sea-water-based and comprises a viscosifying agent, thereby increasing the viscosity of such a fluid. A nonlimiting example of such a viscosifying agent is hydroxyethyl cellulose (HEC). Not intending to be bound by any particular theory, increasing the viscosity of the fluid may lessen the amount of fluid which escapes from a chamber such as chamber 250.

In the embodiment of FIGS. 2A and 2B, the fluid is provided via a fluid conduit 240 that extends from near the platform 110 to the tubular lifter 200. In this embodiment, the fluid conduit 240 comprises one or more hoses. In this embodiment, the fluid conduit 240 extends to the piston 210 through suitably sized interior bores and/or passages formed in each of the securing mechanism 230, the mandrel 220, and the anti-slip mechanism 260. In this embodiment, the fluid conduit 240 is secured in fluid communication with a fluid delivery bore of piston 210. Accordingly, fluid may be passed through fluid conduit 240, directed through the fluid delivery bore of piston 210, and into the chamber 250. Alternatively, the fluid conduit may comprise any suitable system or device for providing fluid communication to a fluid piston chamber within the lifter 200 such as chamber 250. Further, it will be appreciated that in alternative embodiments, fluid conduits 240 and/or other fluid delivery components may be received within, pass through, be routed around, and/or be formed integrally with components of a lifter so that fluid may be selectively delivered to chambers such as chamber 250. Still further, it will be appreciated that fluid conduits 240 and/or other fluid delivery components may comprise or be associated with locally or remotely controlled valves, directional valves such as check valves, and/or any other suitable fluid transfer control components to deliver and/or control delivery of fluid to fluid chambers of lifters or fluid chambers associated with lifters. In the embodiments of FIGS. 2A and 2B, the fluid is supplied to and pumped through the fluid conduit 240 via one or more pumps. In this embodiment, the one or more pumps 112 are located on the platform 110 (as shown in FIGS. 1A-1F). In alternative embodiments, one or more pumps may be located on a proximate support vessel (e.g., a boat, a barge, a ship, or the like).

In this embodiment, fluid is transferred from the one or more pumps, through the fluid conduit 240 along the length of the lifter 200 and to the piston 210. When the fluid within the fluid conduits 240 is pressurized above the pressure of the chamber 250, fluid flows through the fluid delivery bore of the piston 210 and into the chamber 250. In this embodiment, the conduit 240 and/or the fluid delivery bore of the piston 210 comprises a check valve that restricts fluid from escaping the chamber 250 through the fluid delivery bore of the piston 210 and/or the fluid conduit 240. In the embodiment of FIGS. 2A and 2B, the piston 210 is coupled to the securing mechanism 230 via a connecting mandrel 220. Thus, the upward force applied to the piston 210 as fluid is pumped into the chamber 250 is transferred to the securing mechanism 230 through the mandrel 220, and thus to the upper tubular portion 100*b*. In other words, as the piston 210 is moved upward, the connecting mandrel 220, the securing mechanism 230, and the upper tubular portion 100*b* are moved upward as well. In alternative embodiments, the lifter may not comprise a connecting mandrel. In such embodiments, a piston such as piston 210 and a securing mechanism such as securing mechanism 230 may comprise a single or integrated unit.

In the embodiment of FIGS. 2A and 2B, the lifter 200 further comprises an anti-slip mechanism 260. In this embodiment, the anti-slip mechanism 260 is configured to restrict downward movement of the lifter 200 (e.g., piston 210 and mandrel 220) relative to the lower tubular portion 100*a*. In this embodiment, the anti-slip mechanism 260 comprises an assemblage configured to engage an interior wall of the lower tubular portion 100*a*. For example, the anti-slip mechanism 260 may comprise one or more sharp, hard protrusions which, when actuated as described below, extend radially outward from the anti-slip mechanism 260 and cut or dig into the inner wall of the lower tubular portion 100*a*. As will be appreciated by those of skill in the art and with the aid of this disclosure, the radially-extending protrusions are beveled or angled so that radially-extending protrusions slide when moving in one direction (e.g., uphole) with respect to an adjacent inner wall of the lower tubular portion 100*a* and cut or dig into the surface the adjacent inner wall of the lower tubular portion 100*a* when moving in another direction (e.g., downhole). In alternative embodiments, an anti-slip mechanism may comprise dogs, keys, catches, teeth, the like or combinations thereof. In this embodiment, the anti-slip mechanism 260 is configured to engage an interior surface of the lower tubular portion 100*a* upon downward movement of the piston 210 and thereby restrict downward movement of the piston 210, the connecting mandrel 220, the upper tubular portion 100*b*, or combinations thereof, relative to the lower tubular portion 100*a*. In an embodiment, the securing mechanism 230 and the anti-slip mechanism 260 are the same or similar components having opposite orientations within the tubular.

In the embodiment of FIGS. 2A and 2B, the fluid conduit 240 extends to the lifter 200 from near the platform 110. Alternative embodiments may comprise additional fluid conduits, a cable, an electrical connection, or any other connection suitably configured to transfer or transmit a signal, deliver a material or composition, and/or other system or device configured to manipulate the lifter 220. It will be appreciated that it may be desirable to connect or disconnect the fluid conduit 240 at one or more locations between the platform 110 and the lifter 200 and that the conduit 240 and/or other connections optionally comprise one or more couplings, valves, connectors, plugs, and/or the like.

Referring to FIGS. 1D and 1E, the upper tubular portion 100*b* is shown as having been forced upward via the operation of the lifter 200. With the upper tubular portion 100*b* in a raised position, an uppermost tubular segment 100c of the upper tubular portion 100*b* is severed from the upper tubular portion 100*b* (e.g., as shown by sever-line 140) and removed. In this embodiment, severing the tubular 100 may be accomplished in a variety of ways. As described above with regard to cut-line 130, severing the tubular 100 may comprise cutting the tubular using a suitable apparatus (e.g., a cutting torch, a plasma torch, a water jet, a cavitation jet, saws, explosive cutters or the like).

Referring to FIG. 1F, the upper tubular portion 100*b* is shown after the tubular segment 100*c* has been separated from the remainder of the upper tubular portion 100*b*. Once severed, the tubular segment 100*c* is removed from the platform 110 to a support vessel 150 (e.g., a boat, a barge, a ship, or the like). In this embodiment, the crane or hoist 115 located on the platform 110 moves the tubular segment 100*c* following separation from the upper tubular portion 100*b*. Alternatively, a crane or hoist 115 may be located on an adjacent support vessel 150, which may be the same or different from the support vessel receiving tubular segments 100*c*. As shown in FIG. 1F, the tubular segment 100*c*, is removed from the platform 110 to a nearby and/or adjacent support vessel 150 using the crane or hoist 115. In an alternative embodiment, the tubular segment 100*c* may be placed on the deck of the platform 110 for some period of time or disposed of otherwise.

Figure 1G:
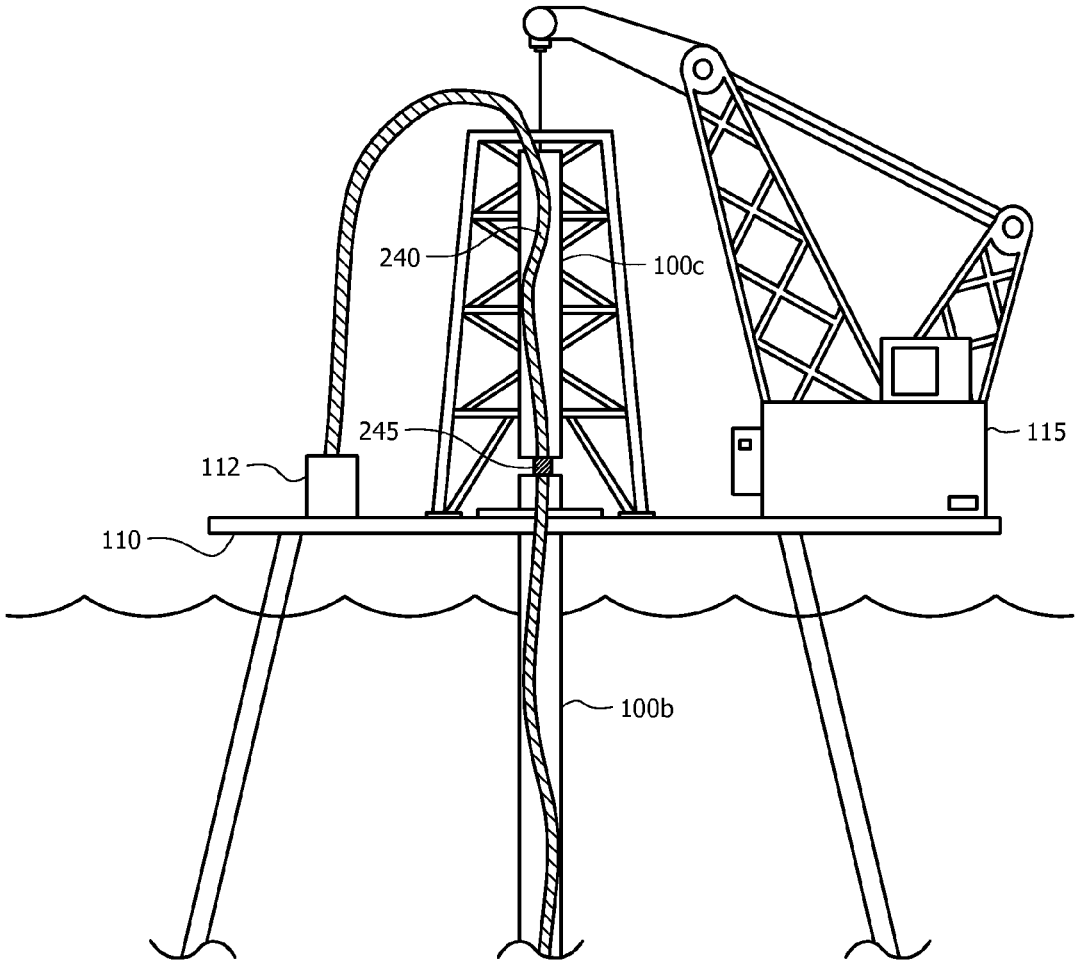
FIG. 1G is a partial cutaway view showing a fluid conduit traversing the tubular, that fluid conduit comprising a coupler.
Figure 1H:
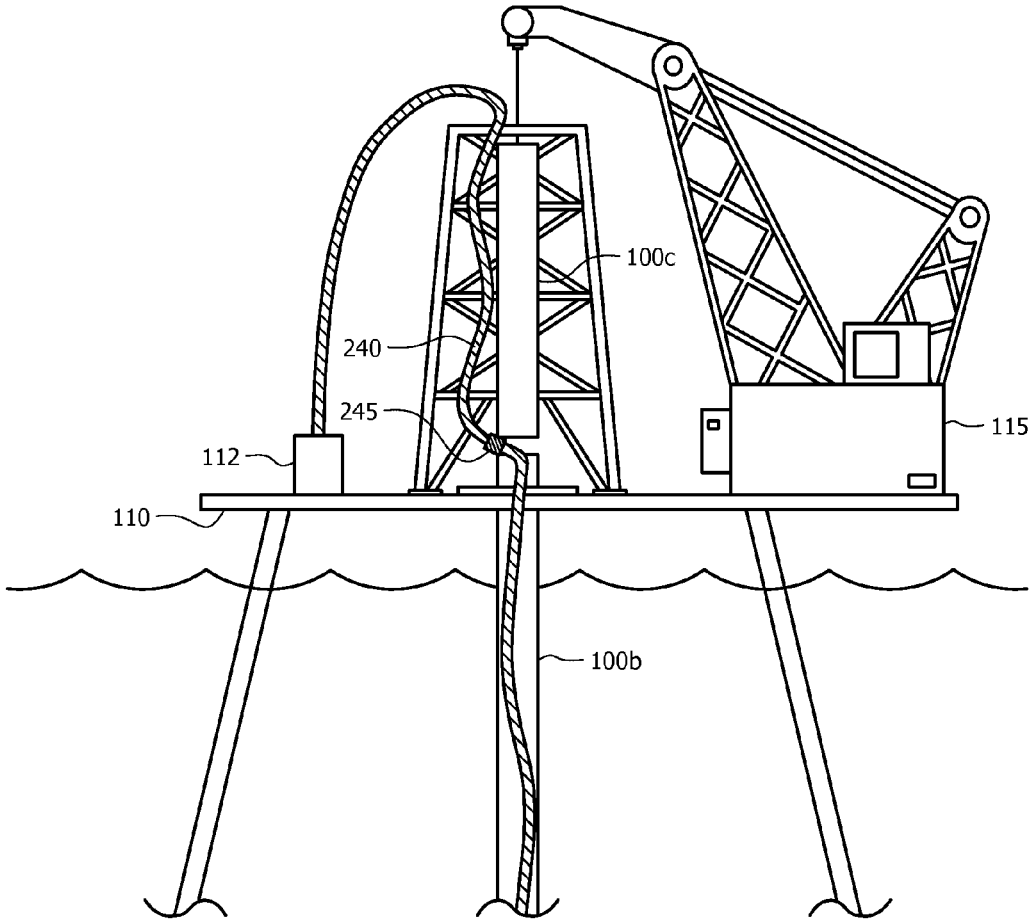
FIG. 1H is a partial cutaway view showing a fluid conduit having been removed from the interior bore of the uppermost tubular segment.

In embodiments as discussed with reference to FIGS. 2A and 2B, the fluid conduit 240 extends from near the platform 110 through the interior bore of the upper tubular portion 100*b* to the lifter 200. Thus, the fluid conduit 240 traverses the interior bore of the upper segment 100*c* that is to be separated from the upper tubular portion 100*b*. Accordingly, it is necessary to remove the fluid conduit 240 from the interior bore of tubular segment 100*c* prior to or after severing the tubular segment 100*c* from the upper tubular portion 100*b*. As shown in FIGS. 1G and 1H, re-routing the fluid conduit 240 comprises providing a union or joint using a coupling 245, disconnecting the fluid conduit 240 at the coupling 245, removing the fluid conduit 240 from the interior bore of the tubular segment 100*c*, and reconnecting the fluid conduit 240 at the coupling 245 once the tubular segment 100*c* is removed. In this embodiment, the coupling 245 comprises a male end and a female end, the male end being configured to be inserted within and joined to the female end to allow fluid flow therethrough when joined. In alternative embodiments, the fluid conduit 240 may comprise a plurality of couplings 245 spaced along the length of fluid conduit 240 such that different couplings may be disconnected as the upper tubular 100*b* is lifted up and successive tubular segments 100*c* are removed. Slack, as shown in FIG. 1 H, in the fluid conduit 240 resulting from successive removal of tubular segments 100*c* may be addressed for example by reeling up the fluid conduit 240 on a reel or spool or by removing segments of the fluid conduit, which may likewise be transferred to support vessel 150 via crane 115 or otherwise stored on platform 110.

In alternative embodiments, a coupling such as coupling 245 may comprise a threaded coupling, a joint, a union, or combinations thereof Appropriate couplings will be readily apparent to those of ordinary skill in the art. In alternative embodiments, a coupling such as coupling 245 may comprise one or more selectively openable and closable valves operable to limit fluid loss from a coupling during the process of disconnecting and connecting that coupling.

In still other alternative embodiments, a connection to a lifter such as lifter 200 may comprise an electrical connection, a cable, or the like. In such embodiments, a suitable coupling may be provided for re-routing that connection. For example, where an electrical connection is provided, a suitable coupling may comprise one or more electrical plugs and/or receptacles. Other suitable couplings will be apparent to those of skill in the art with the aid of this disclosure.

After the tubular segment 100*c* has been severed from the upper tubular portion 100*b* and removed as shown in FIG. 1F, the operation of the lifter 200 is resumed and one or more of the steps of the methods disclosed herein is repeated in as many iterations as is necessary to move the tubular 100 from the body of water 30. In an alternative embodiment, operation of a tubular lifter may be resumed for so many iterations as is necessary to decrease the weight of an upper tubular portion 100*b* until such weight does not exceed a capacity of a platform such as platform 110, a crane or hoist such as crane or hoist 115, or a support vessel such as support vessel 150, thereby allow removal of the remaining tubular portion without further use of the lifter. Upon removal of the last segment of upper tubular portion 100*b*, the lifter 200 may likewise be lifted up (via attachment of securing mechanism 230) and recovered for further use on another location. Upon removal of the lifter 200, the piston 210 will disengage from the lower tubular portion 100*a*, thereby freeing the contents of chamber 250 to the surrounding environment, thereby illustrating the preference for use of an environmentally friendly and compatible fluid (e.g., seawater) for use in chamber 250.

Figure 5:
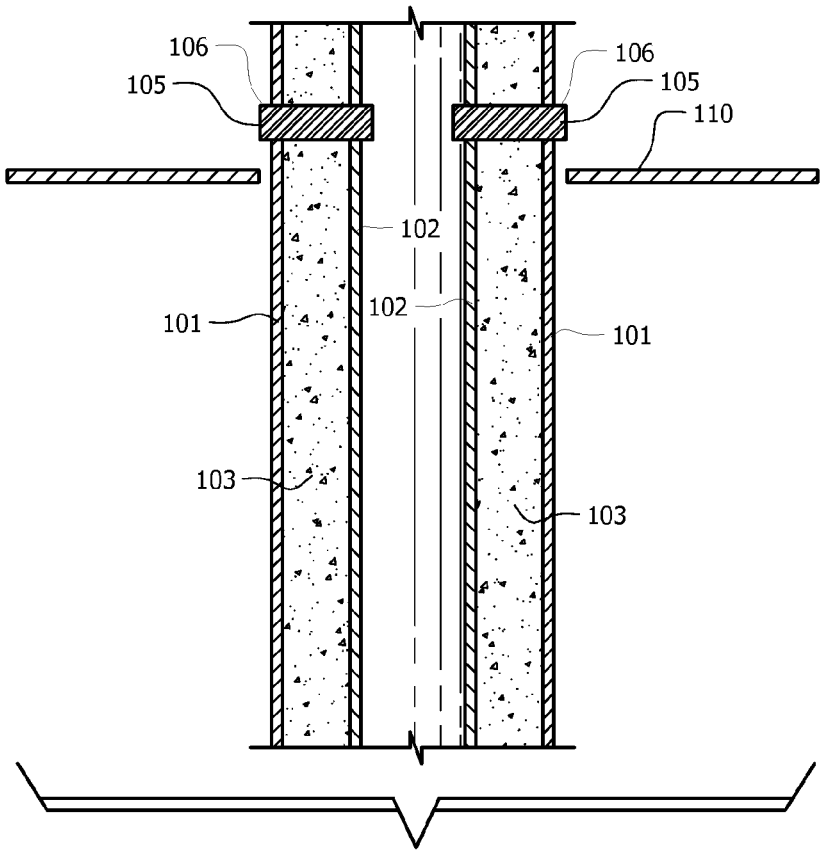
FIG. 5 is a partial cutaway view showing two concentric tubular members secured with respect to each other via pins extending through the walls of each tubular member.

Referring now to FIG. 5, the tubular 100 to be lifted comprises two concentrically-arranged tubular members, 101 and 102 respectively. The tubular 100 further comprises a cement layer 103 filling the annular space between tubular members 101 and 102. In this embodiment, it is desirable to secure the two tubular members 101, 102 with respect to one another. In other words, it is desirable to fix the first tubular member 101 to the second tubular member 102 so that movement of the first tubular member 101 with respect to the second tubular member 102 along their common central axis is restricted.

In this embodiment, the first tubular member 101 is secured to the second tubular member 102 by pins 105 inserted into holes 106 bored substantially perpendicular to the their common central axis. The pins 105 extend into the holes 106 that are bored through the walls of each of the first tubular member 101 and the second tubular member 102. The pins 105 are inserted substantially perpendicular to the direction in which the relative movement between the first tubular member 101 and the second tubular member 102 is restricted.

In an embodiment, the holes 106 are bored through the first tubular member 101 and the second tubular member 102 at distances above the floor of the platform 110. For example, the holes 106 may be bored and the pins 105 may be inserted prior to each successive removal of a tubular segment 100*c*. For example, holes 106 and pins 105 may be inserted in the upper tubular portion 100*b* prior to lifting of the upper tubular portion and removing a first tubular segment 100*c* (e.g., where the uppermost end of tubular 100 is about even with the platform 110 as shown in FIGS. 1A-C). After lifting, holes 106 and pins 105 may be inserted in the upper tubular portion 100*b* below the sever-line 140 as shown in FIG. 1E, and preferably prior to formation of the sever-line 140. In alternative embodiments, a hole may be bored and a pin may be provided substantially adjacent to the floor of a platform or at a distance below a floor of a platform. In still another alternative embodiment, a plurality of holes may be bored at multiple distances above or below a floor of a platform and pins may be inserted within such holes, and such holes/pins may be placed before and/or after lifting of the upper tubular portion 100*b* and/or removal of tubular segments 100*c*.

In some embodiments, a hole and a pin may extend through two or more tubular members, such as tubular members 101 and 102 respectively, at one or more points along a tubular segment such as tubular segment 100*c*. In such embodiments, it may be necessary to secure the tubular members comprising an upper tubular portion such as upper tubular portion 100*b* prior to severing the tubular segment. In such embodiments, the tubular members of the remaining upper tubular portion may be fixed to each other as discussed herein.

Figure 3A:
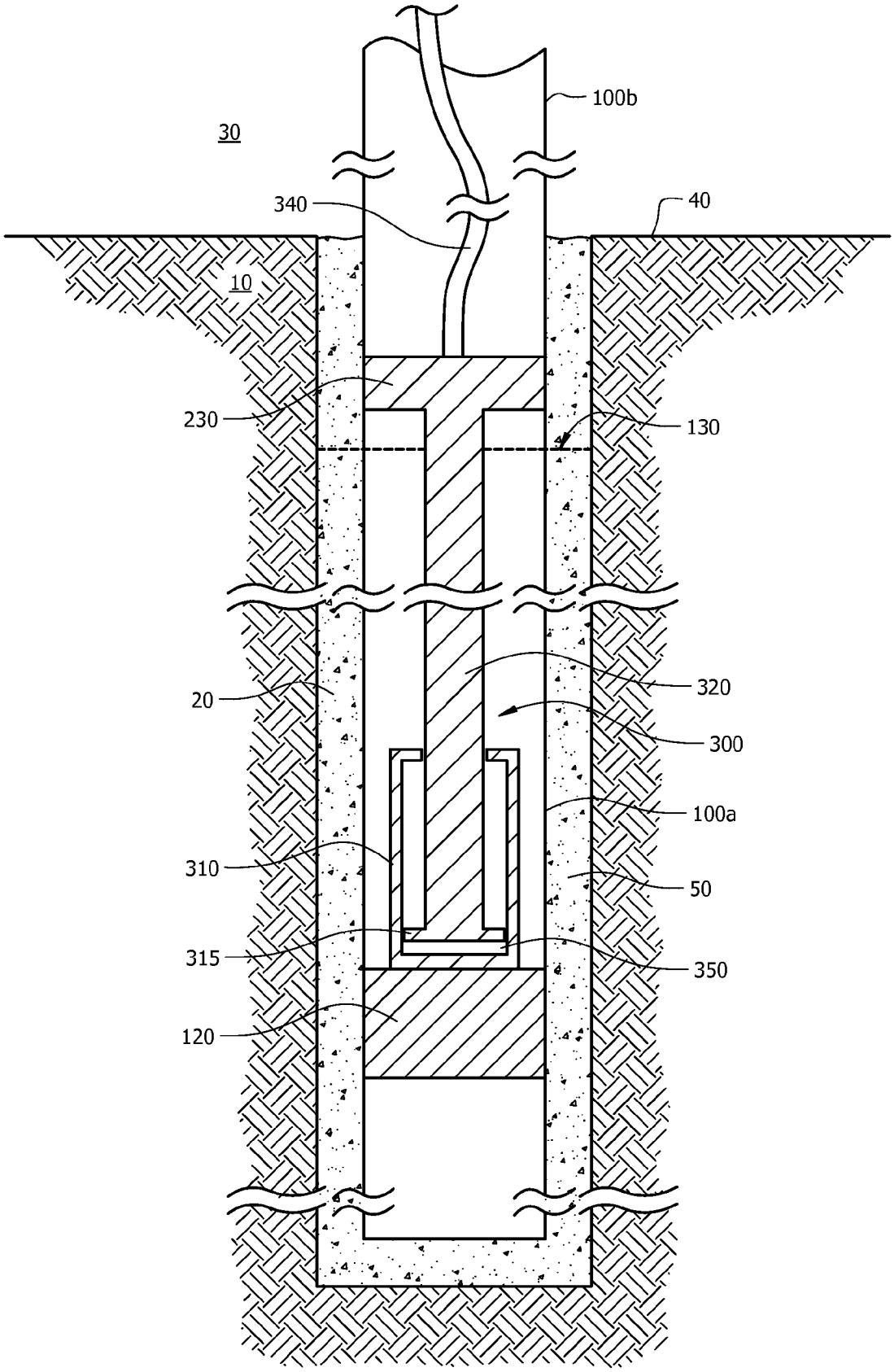
FIG. 3A is a partial cutaway view showing an alternative embodiment of a lifter inserted within the tubular and before lifting the tubular.
Figure 3B:
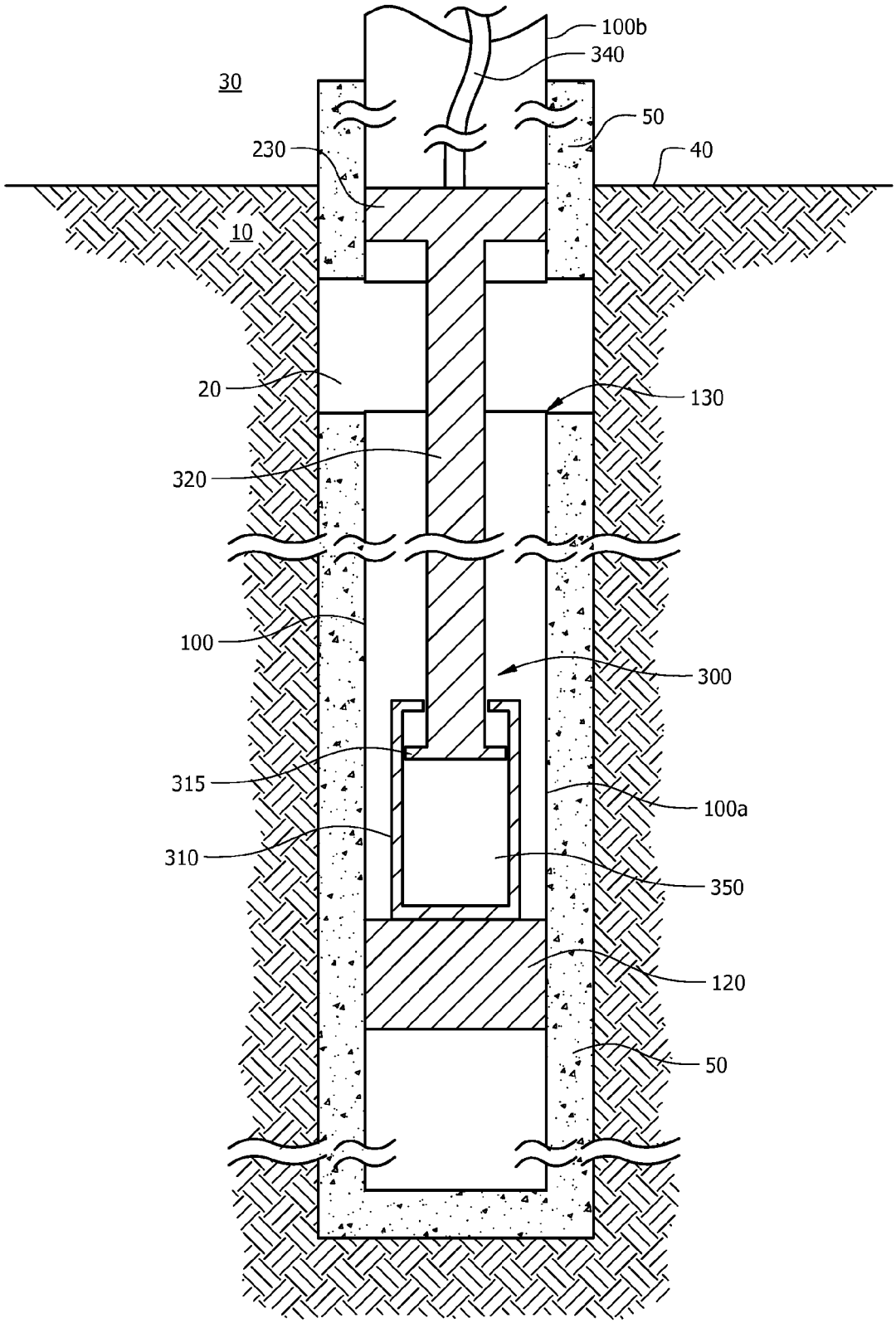
FIG. 3B is a partial cutaway view showing the lifter of FIG. 3A inserted within the tubular and after at least partially lifting the tubular.

Referring now to FIGS. 3A and 3B, an alternative embodiment of a lifter 300 is shown. The lifter 300 comprises a substantially cylindrical body 310 comprising an interior bore that is accessible through an upper end of the body 310. The connecting mandrel 320 is slidably received within the interior bore of the body 310 in a substantially fluid-tight manner. In this embodiment, the end of the connecting mandrel 320 inserted within the body 310 comprises a piston 315 configured to create a substantially fluid-tight seal against the interior bore of the body 310. The connecting mandrel 320 protrudes from the upper end of the body 310. The lower end of the body 310 is sealed and does not provide access to the interior bore of the body 310. Accordingly, a substantially fluid-tight interior chamber 350 within the body 310 is at least partially defined by the piston 315 and the walls of the interior bore of the body 310. The lifter 300 comprises a securing mechanism which is substantially similar in form and function to securing mechanism 230. The lifter 300 rests upon a base 120 and is operably coupled to the securing mechanism 230 via a connecting mandrel 320.

In operation, pumping a fluid into the chamber 350 via fluid conduit 340 causes the distance between the lower end of the body 310 resting on the base 120 and the piston 315 to increase. FIG. 3A shows the lifter 300 as configured with a first fluid volume present in a chamber 350 while FIG. 3B shows the lifter 300 as positioned with a second fluid volume present in the chamber 350 where the second fluid volume is greater than the first fluid volume. As fluid is pumped in the chamber 350, the pressure within the chamber 350 increases, thereby resulting in the application of a substantially upward force against the piston 315 and a substantially downward force against the base 120. As fluid continues to be pumped into the chamber 350, the substantially upward force applied to the piston 315 moves the piston 315, the connecting mandrel 320, the securing mechanism 230, and the upper tubular portion 100*b* upward. In this embodiment, fluid may be routed and/or delivered to the chamber 350 through fluid conduit 340 in substantially the same manner as fluid is delivered through fluid conduit 240 of lifter 200 to the chamber 250 of lifter 200.

Figure 3C:
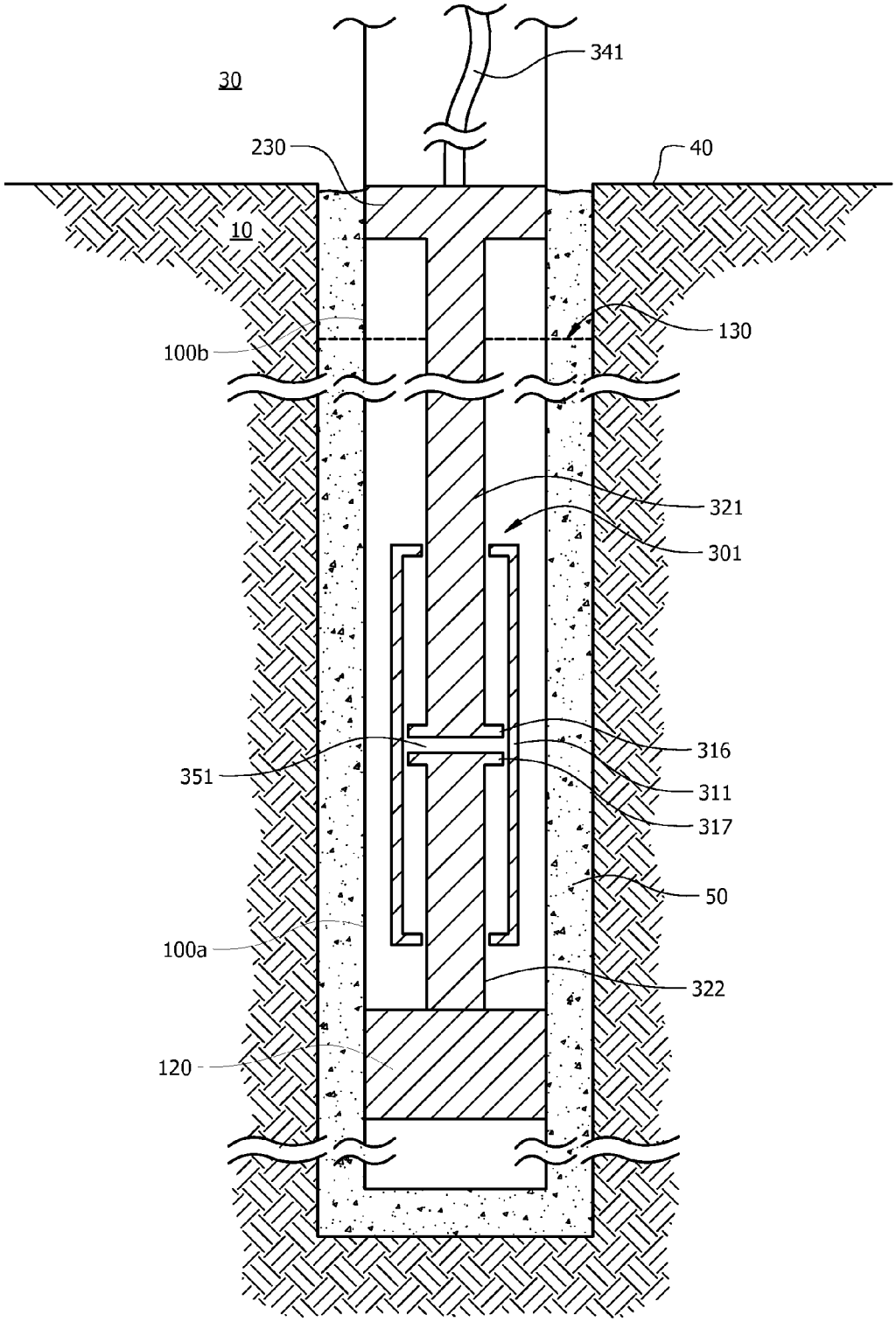
FIG. 3C is a cutaway view showing an alternative embodiment of a lifter inserted within the tubular and before lifting the tubular.

Referring to FIG. 3C, an alternative embodiment of a lifter 301 is shown. The lifter 301 comprises a body 311, the body 311 being substantially cylindrical and comprising an interior bore. The lifter 301 comprises a first connecting mandrel 321 slidably received within the interior bore of the body 311 in a substantially fluid-tight manner from a first end of the body 311 and a second connecting mandrel 322 slidably received within the interior bore of the body 311 in a substantially fluid-tight manner from a second end of the body 311. A first piston 316 configured to create a substantially fluid-tight seal against the interior bore of the body 311 is coupled to the first connecting mandrel 321 and a second piston 317 also configured to create a substantially fluid-tight seal against the interior bore of the body 311 is coupled to the second connecting mandrel 322. The lifter 301 thus comprises a chamber 351 at least partially defined by the first piston 316, the second piston 317, and the walls of the interior bore of the body 311. As a fluid is pumped into the chamber 351 via fluid conduit 341, the distance between the first piston 316 and the second piston 317 increases, thereby actuating the lifter 301 and lifting the upper tubular portion as described herein. In this embodiment, fluid may be routed and/or delivered to the chamber 351 through fluid conduit 341 in substantially the same manner as fluid is delivered through fluid conduit 240 of lifter 200 to the chamber 250 of lifter 200.

Figure 3D:
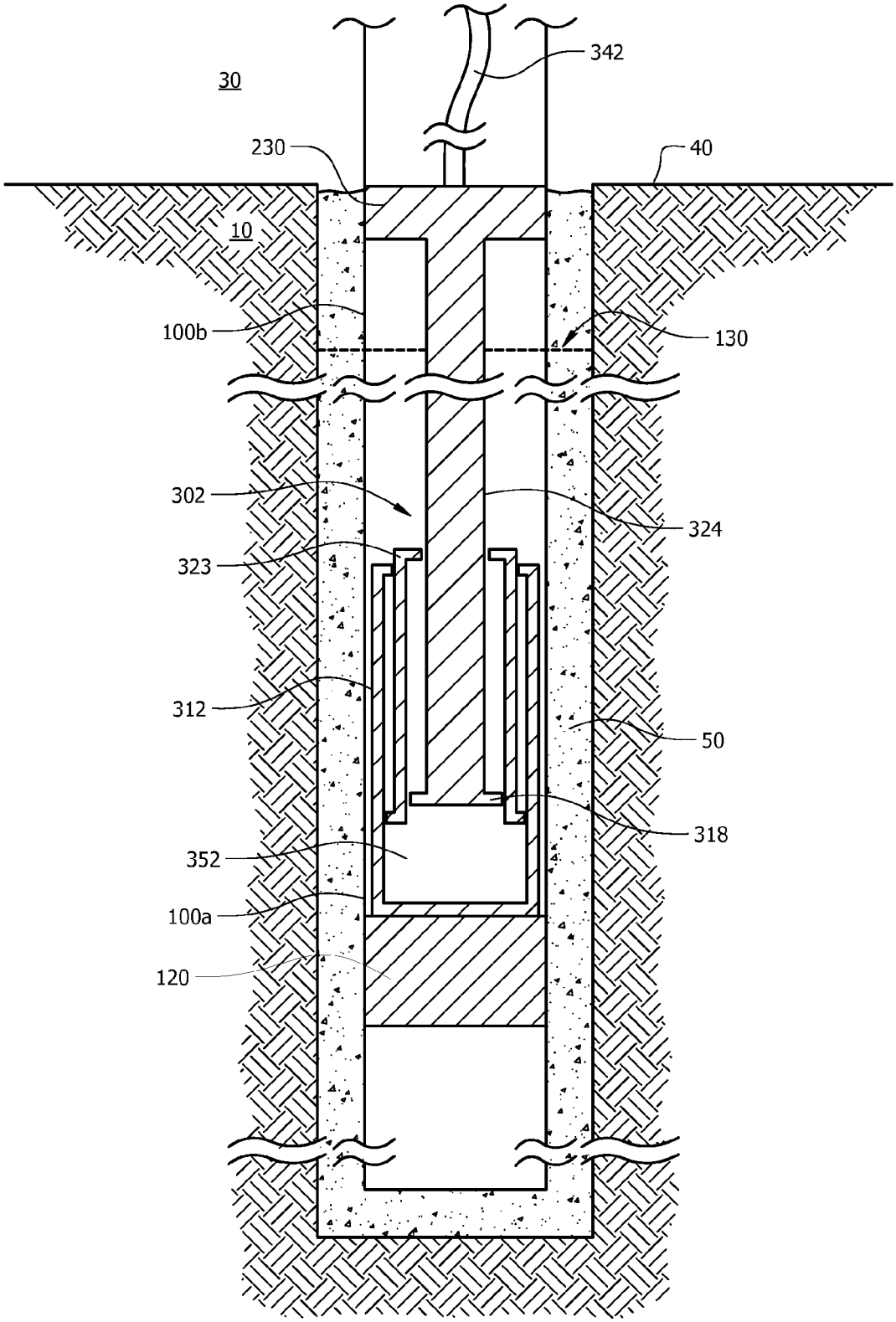
FIG. 3D is a cutaway view showing an alternative embodiment of a lifter inserted within the tubular and before lifting the tubular.

Referring to FIG. 3D, yet another alternative embodiment of a lifter 302 is shown. The lifter 302 is coupled to securing mechanism 230 via mandrel 324. In this embodiment, the lifter 302 comprises a body 312, the body 312 being substantially cylindrical and comprising an interior bore. The lifter 302 comprises a concentric, nested piston assembly, which further comprises a nested piston 323 slidably received within the interior bore of the body 312 in a substantially fluid-tight manner from one end, and an innermost piston 318 slidably received within the interior bore of the nested piston 323, the innermost piston 318 configured to create a substantially fluid-tight seal against the interior bore of the nested piston 323. While two concentric pistons are shown in the embodiment of FIG. 3D, additional concentric pistons may be incorporated in a nested manner as shown. Slidable seals may be employed between the concentric pistons to maintain a fluid-tight relationship. The other end (e.g., lower end) of the body 312 is enclosed. The lifter 302 thus comprises a substantially fluid-tight chamber 352 at least partially defined by the innermost piston 318, the walls of the interior bore of the body 312, the walls of the interior bore of the nested piston 323, and the lower end of body 312. As a fluid is pumped into the chamber 352 via fluid conduit 342, the concentric, nested piston assembly is extended in length and thereby actuating the lifter 301, moving the mandrel 324 upward, and lifting the upper tubular portion as described herein. In this embodiment, fluid may be routed and/or delivered to the chamber 352 through fluid conduit 342 in substantially the same manner as fluid is delivered through fluid conduit 240 of lifter 200 to the chamber 250 of lifter 200.

Figure 4A:
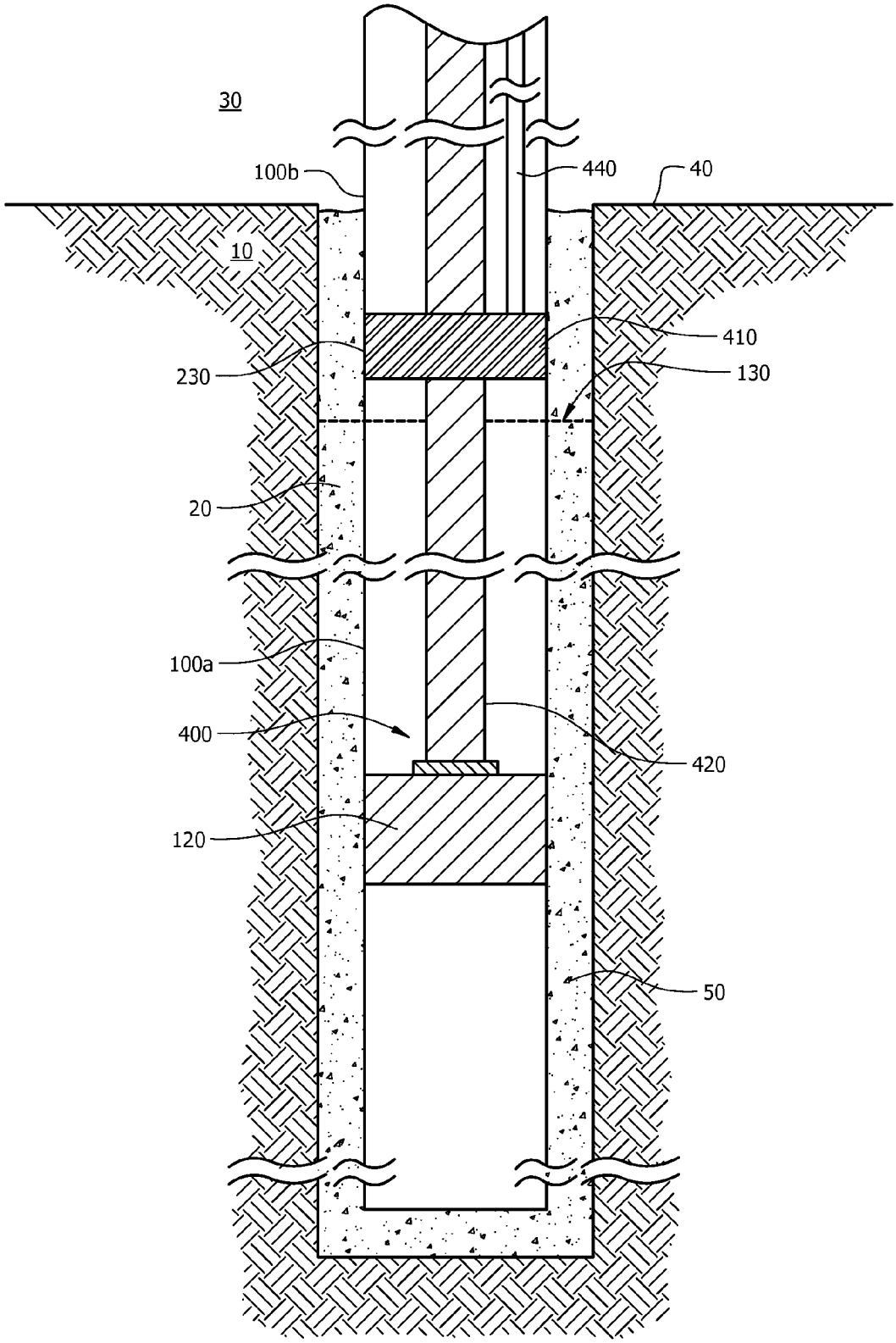
FIG. 4A is a partial cutaway view showing an alternative embodiment of a lifter inserted within the tubular and before lifting the tubular.
Figure 4B:
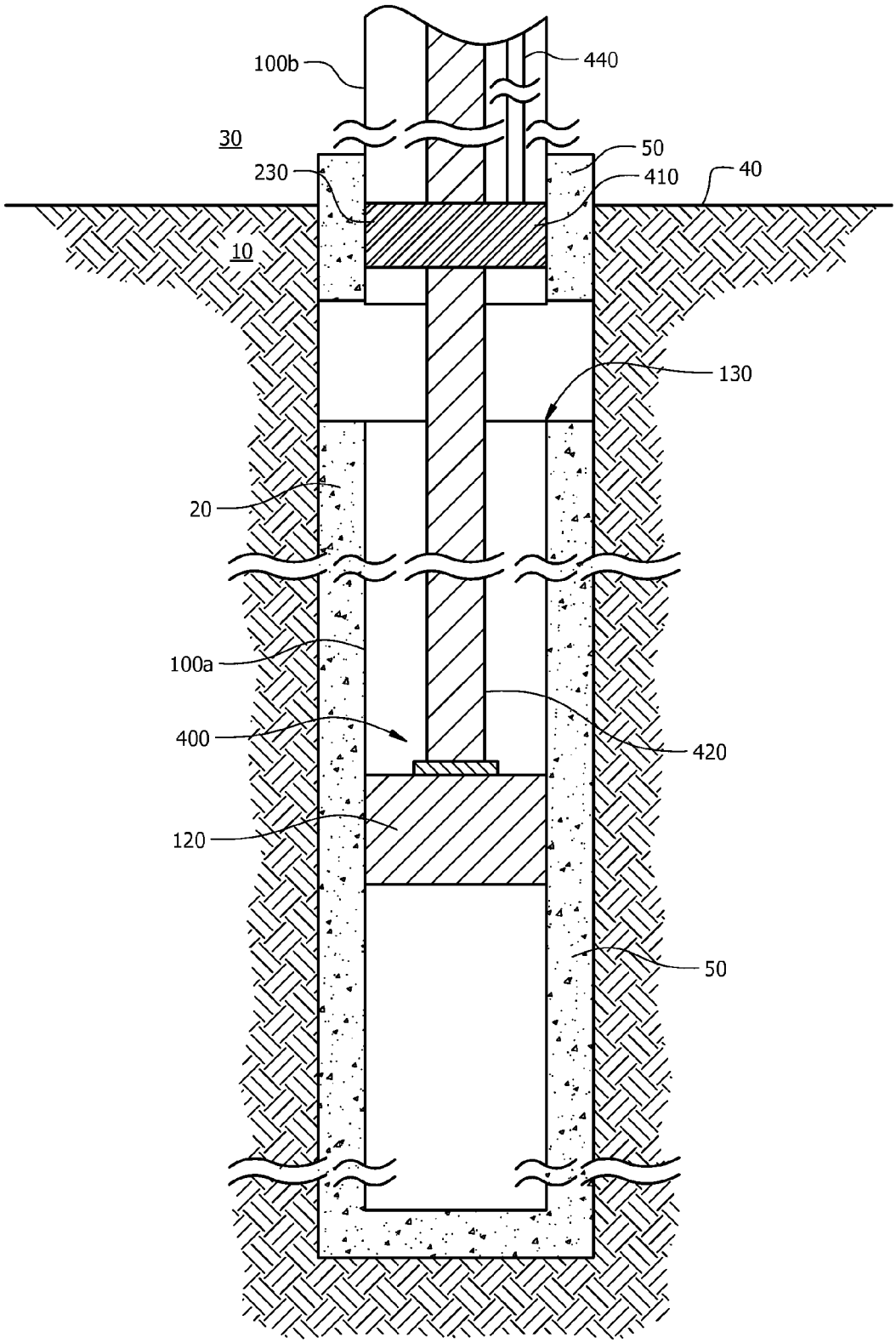
FIG. 4B is a partial cutaway view showing the lifter of FIG. 4A after at least partially lifting the tubular.

Referring to FIGS. 4A and 4B still another alternative embodiment of a lifter 400 is shown. The lifter 400 comprises an externally-threaded mandrel 420 extending through an internally-threaded housing 410. The threads of the mandrel 420 engage the threads of the housing 410 such that rotation of the mandrel 420 with respect to the housing 410 in a given direction about a common central axis causes the housing 410 to move upward along the central axis with respect to the mandrel 420. Similarly, rotation of the mandrel 420 with respect to the housing 410 in the opposite direct about common central axis causes the housing 410 to move downward along the axis of rotation with respect to the mandrel 420.

The housing 410 comprises at least one motor. When operated, the motor applies a rotational force causing the housing 410 to rotate with respect to the mandrel 420. In this embodiment, the motor comprises a hydraulic motor. The hydraulic motor is configured to apply the rotational force when a fluid is provided to the hydraulic motor via fluid conduit 440. In alternative embodiments, the motor comprises an electric motor which will apply a rotational force when an electrical current is provided thereto. The housing 410 comprises the securing mechanism 230. As discussed above, the securing mechanism 230 engages the upper tubular portion 100*b*. Accordingly, when the rotation force is applied by the motor, the housing 410 to moves upward along the mandrel 420 and the upper tubular portion 100*b* is likewise moved upward.

Figure 4C:
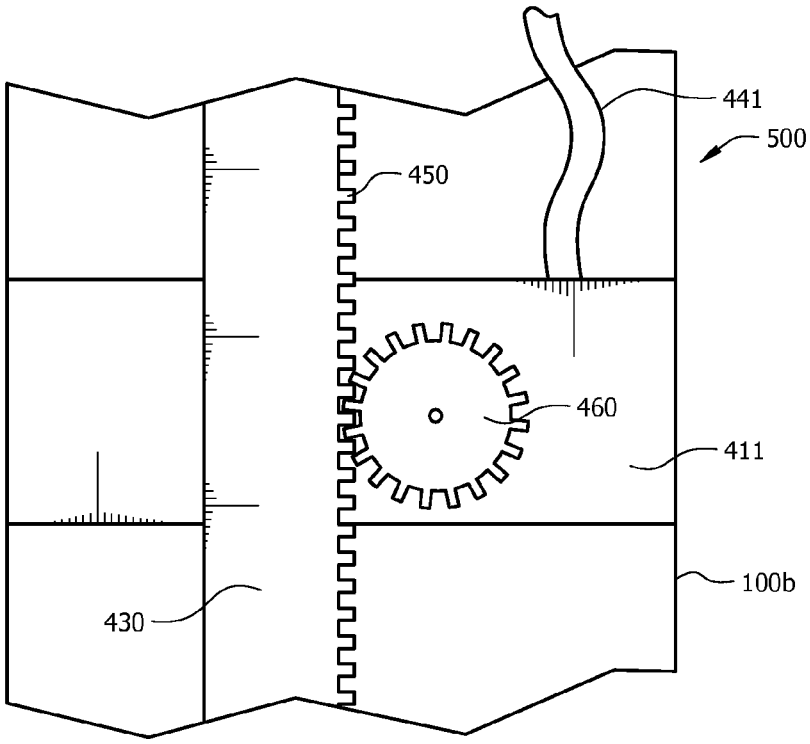
FIG. 4C is a partial cutaway view showing an alternative embodiment of a lifter inserted within the tubular.

Referring now to FIG. 4C, yet another embodiment of a lifter 500 is shown. The lifter 500 comprises a cogged mandrel (e.g., the rack of a rack and pinion system) 430 extending through a housing 411 (similar to the mandrel/housing arrangement shown in FIGS. 4A and 4B). In this embodiment, the housing 411 comprises a pinion gear 460, the cogs of which engage the cogs of the mandrel 430 (e.g., a rack and pinion system). In this embodiment, the housing 411 further comprises a motor. When operated, the motor is configured to apply a rotational force to the pinion gear 460. Rotation of the pinion gear 460 in a given direction causes the housing 411 to move along the cogs of the mandrel 430 (i.e., the "rack"). In this embodiment, the motor comprises a hydraulic motor. The hydraulic motor is configured to apply the rotational force when a fluid is provided to the hydraulic motor via fluid conduit 441. In alternative embodiments, the motor comprises an electric motor which will apply a rotational force when an electrical current is provided thereto.

It will be appreciated that any one of the above-described lifters 200, 300, 301, 302, 400, and 500 may be used to lift at least a portion of a tubular. Further, it will be appreciated that any one of lifters 300, 301, 302, 400, and 500 may substantially replace the use of lifter 200 in the method of decommissioning a wellbore described above and shown with reference to FIGS. 1A-1H.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural or other details supplementary to the disclosure.

What is claimed is:

1. A method of raising a portion of a tubular, comprising:

attaching a lifter to the tubular associated with a wellbore;

severing the tubular into an upper tubular portion and a lower tubular portion; and operating the lifter to transmit a downward force to a subterranean formation via a surface of the wellbore formed in the subterranean formation while also operating the lifter to transmit an upward force to the upper tubular portion.

2. The method of claim 1, wherein the downward force is transmitted from the lifter to the subterranean formation via the lower tubular portion.

3. The method of claim 1, wherein the downward force is transmitted from the lifter to the subterranean formation via a plug in the wellbore.

4. The method of claim 1, wherein at least a portion of the lifter is carried within the tubular.

5. The method of claim 1, wherein the lifter comprises a securing mechanism for restricting downward movement of the upper tubular portion of the tubular relative to the lifter.

6. The method of claim 1, wherein the lifter comprises an anti-slip mechanism for restricting downward movement of the lifter relative to the lower tubular portion of the tubular.

7. The method of claim 1, wherein a secondary upward force is applied to the tubular and the secondary upward force is not generated by the lifter.

8. The method of claim 1, further comprising:

generating the upward force and the downward force by operating a hydraulic piston of the lifter.

9. The method of claim 1, further comprising:

generating the upward force and the downward force by introducing fluid between a portion of the lifter and a plug in the wellbore.

10. The method of claim 1, further comprising:

generating the upward force and the downward force by rotating a first portion of the lifter relative to a second portion of the lifter.

11. The method of claim 10, wherein the first portion of the lifter is substantially coaxial about an axis shared with the second portion of the lifter and the relative rotation occurs about the axis.

12. The method of claim 1, wherein the lifter comprises:

a securing mechanism configured to restrict movement of the securing mechanism relative to the upper tubular portion; and a piston configured to be received within the lower tubular portion and configured to promote a seal between the piston and the lower tubular portion.

13. The method of claim 12, wherein the lifter further comprises:

an anti-slip mechanism configured to restrict downward movement of the lifter relative to the lower tubular portion.

14. The method of claim 12, wherein the lifter further comprises:

a mandrel connected between the securing mechanism and the piston.

15. The method of claim 12, wherein the lifter further comprises:

a fluid conduit at least partially carried within the upper tubular portion.

16. The method of claim 15, wherein the fluid conduit selectively provides fluid to a space between the piston and a plug in the wellbore.

17. The method of claim 12, wherein the securing mechanism restricts downward movement of the securing mechanism relative to the upper tubular portion.

18. The method of claim 12, wherein the downward force is transmitted from the lifter to the subterranean formation via the lower tubular portion.

19. The method of claim 12, wherein the downward force is transmitted from the lifter to the subterranean formation via a plug in the wellbore.

20. The method of claim 12, further comprising:

generating the upward force and the downward force by introducing fluid between the piston of the lifter and a plug in the wellbore.

* * * * *